US006436263B1

(12) United States Patent
Inoue

(10) Patent No.: US 6,436,263 B1
(45) Date of Patent: Aug. 20, 2002

(54) ELECTRODEPOSITION PAINTING SYSTEMS AND METHODS

(75) Inventor: Akito Inoue, Chofu (JP)

(73) Assignee: Polytechs, Inc., Tokyo (JP)

( * ) Notice: Subject to any disclaimer, the term of this patent is extended or adjusted under 35 U.S.C. 154(b) by 0 days.

(21) Appl. No.: 09/556,596

(22) Filed: Apr. 21, 2000

(30) Foreign Application Priority Data

Nov. 12, 1998 (JP) ..... 10-338444
Nov. 12, 1999 (WO) ..... PCT/IB99/02130

(51) Int. Cl.[7] ..... C25D 13/24
(52) U.S. Cl. ..... 204/626
(58) Field of Search ..... 204/626, 622, 204/482

(56) References Cited

U.S. PATENT DOCUMENTS 5,047,128 A * 9/1991 Hawkins et al. ..... 204/482
5,078,850 A * 1/1992 Inoue ..... 204/626

* cited by examiner

*Primary Examiner*—Kishor Mayekar
(74) *Attorney, Agent, or Firm*—Loudermilk & Associates

(57) ABSTRACT

Electrodeposition (ED) systems and methods are disclosed where acid control is possible without adding acid from outside when acid tends to be depleted. A mixture of high neutralizer removal type membrane electrodes and low neutralizer removal type membrane electrodes are placed in an ED tank. To each of these two types of electrodes separate and independent electrolyte circulation systems are connected. To each of these circulation system are connected each correspondingly first and second electrolyte conductivity control means, each of which works to add D.I. water, as a dilution media, to corresponding electrolyte circulation system, when the conductivity exceeds pre-set reference conductivity values. The reference conductivity set point at which value the second electrolyte control means will add D.I. water to the second electrolyte circulation system preferably is set higher than the reference conductivity set point at which value the first electrolyte control means will add D.I. water to the first electrolyte circulation system.

37 Claims, 12 Drawing Sheets

ELECTRODEPOSITION PAINTING SYSTEMS AND METHODS

FIELD OF THE INVENTION

This invention relates to electrodeposition (hereafter referred to as ED) coating systems and methods, and more particularly to ED coating systems/methods utilizing a first electrode which is to be coated, and plurality of second electrodes provided in association with the first electrodes.

BACKGROUND OF THE INVENTION

ED coating generally may be broadly divided into two categories, including one using a coating material of an anion type and the other using a coating material of a cation type. Since, in either of these ED coatings, uniformity and adhesion of the coating on an article to be coated are excellent and the degree of pollution is generally low, these ED coating techniques have been widely applied recently to prime coating or one coat finishing of metal materials, such as automobile vehicle bodies.

As for the coating materials used in such ED coatings, as a coating material of an anion type, for example, a resin of molecular weight of 2000 often is used to which a carboxyl group is attached to make it water soluble; in the case of a coating material of a cation type, an amino group is attached to the resin to make it water soluble. Even with these water-soluble coating materials, however, the degree of ionization after being dissolved in water is very low. For this reason, at present, in the case of the coating material of an anion type, an alkaline neutralizing agent such as tai-ethylamine, for example, is mixed thereinto, while, in the case of the coating material of a cation type, an acidic neutralizing agent such as acetic acid is mixed thereinto. In both cases, neutralizing is effected, respectively, to thereby increase the degrees of ionization in the water.

As seen above, neutralizing agents are added and mixed to increase the degree of ionization in accordance with the properties of the resin components of the respective coating material. On the other hand, when the ED coating on the articles to be coated proceeds thereby decreasing the resin component in the solution, the coating material should be successively supplied from outside. Accordingly amine or acetic acid, as the neutralizing agent, accumulate in the solution, whereby a phenomenon such as redissolving of the coated film or pinholes occurs, so that the efficacy of the ED coating is impaired to a considerable extent.

For this reason, as described in Japanese Patent Kokoku (Post-Exam. Publn.) No. 22231/1970, for example, so-called pH control is performed to increase the efficiency. By such a method that a second electrode is separated from the article to be coated and from the aqueous solution by use of an ion-exchange membrane or the like, amine or acetic acid are osmotically extracted, to thereby prevent the accumulation of neutralizing agent in the aqueous solution.

ED coating of a cation type using a coating material of a cation type will be hereunder described. In ED coating of a cation type an anion exchange membrane has been used as a membrane. This anion exchange membrane normally has an efficiency of $8–10\times10^{-6}$ (mole/Coulomb) as an electric efficiency of removing the acid (coulombic acid removing rate). The acid (neutralizing agent) added to the aqueous solution (ED bath coating material) in the electrodeposition coating bath amounts to a value A contained in the coating material that is supplied to the ED bath.

On the other hand, the total amount of the acid taken out from the ED bath coating material to the outside equals a value B, which includes: (1) 10–20% of the value A taken out as acid contained in a UF filtrate which is used as a rinsing liquid after the ED coating; (2) 5–10% of the value A taken out as acid contained in the coated film; and (3) 70–80% of the value A, which is removed by the membrane electrodes. Although it is ideal that the value A is equal to the value B, it is difficult to adjust in order to obtain such an equality by conventional techniques. In general, B>A is adopted, whereby, if needed, a small amount of acid is added to the bath to keep a generally more exact acid balance.

For such reasons, when all of the electrodes provided in the electrodeposition bath happen to be the membrane electrodes for extracting acid, removal of the acid becomes highly excessive, whereby such disadvantages are presented that the acid as being the neutralizing agent lacks and the acid needs to be periodically supplied from the outside and so forth, so that the control of the neutralizing agent in the ED bath coating material becomes troublesome and the acid is uselessly consumed. For this reason, sometimes some of the electrodes are replaced with so-called bare electrodes having no membranes, or with membrane electrodes having extremely low acid removal rate, so that removal of the acid can be better balanced.

As described above, when the rate of removal is $8–10\times10^{-6}$ (mole/Coulomb), removal of the acid becomes excessive and when the rate of removal is $5–6\times10^{-6}$ (mole/Coulomb), removal of the acid becomes more nearly ideally balanced, so that a neutral membrane having the latter rate of acid removal may be used sometimes.

SUMMARY OF THE INVENTION

The above-mentioned conventional techniques require, in the event that the acid concentration in the ED bath becomes too low, to add acid directly from outside. There is, however, a disadvantage in this method as such work of addition of acid not only requires labor but also it is quite dangerous. Further, there is an additional problem with such techniques in that there is a sudden change in the acid concentration between before and after addition of acid, which tends to cause abrupt change in the paint characteristic.

The present invention aims to provide ED coating systems and methods which eliminate such problems of conventional techniques and provide a new technique, with interest paid to the function of acid removal of membrane electrodes, that enable adjustment without directly adding acid from outside when acid concentration in the bath tends to go too low.

To attain the goal mentioned above, an ED coating method is proposed which comprises a first electrode as an article to be coated provided in an ED bath and a plurality of second electrodes provided in association with the first electrode, wherein current is passed between the article to be coated and the second electrodes through an aqueous solution of a substance contained in the electrodeposition bath, to thereby electrodeposit the substance for forming a coating film onto the article to be coated, and the second electrodes comprise a number of membrane electrodes having a membrane portion which separates the electrode from the aqueous solution. Some of these second electrodes are a low acid removal type electrode, each of which is provided with corrosion resistant electrode material and first membrane portion having a function of precluding most of the flow of ionized neutralizing agent in the aqueous solution from being extracted, and the remaining second electrodes are high acid removal type membrane electrodes being each provided with a second membrane portion having a function of osmotically extracting the neutralizing agent, wherein these low acid removal type membrane electrodes and high acid removal type of membrane electrodes are placed along the bath paint tank wall.

Further each of the high acid removal type membrane electrodes is provided with a first electrolyte circulation system to run electrolyte from one end to the other end between its second type membrane and electrode pipe, likewise each of the low acid removal type membrane electrodes is provided with a second electrolyte circulation system functioning basically the same as the first electrolyte circulation system, independently from the first system. Both of the first and second electrolyte circulation systems are provided with correspondingly first and second conductivity control circuits/units which are activated if the conductivity exceeds a pre-set reference conductivity value in order to controllably introduce D.I. water to corresponding electrolyte as dilution media, where the second conductivity control circuit/unit has a higher preset reference value of conductivity than that of the first conductivity control circuit/unit above which reference conductivity point D.I. water is introduced into the electrolyte.

Also in accordance with certain embodiments of the present invention, a DC voltage is applied in such a way that the article to be coated is connected to a negative pole and each of the membrane electrodes (second electrodes) is connected to a positive pole. Immediately, ED coating starts, and the positively charged paint resin and pigment colloids in the aqueous solution start to migrate toward the article to be coated which is negatively charged, forming a coating film on its surface, while leaving negatively charged acid (acetic acid) in the aqueous solution.

In this case, as mentioned above, as soon as ED coating starts the acid (acetic acid), as a neutralizer, starts to migrate toward the second membrane electrodes. The acid, however, will be mostly precluded by the membrane electrodes with cation ion-exchange membranes, and, as a result, if it is left alone acid will accumulate in the aqueous solution. On the other hand, as other of the second membrane electrodes have second membranes which pass acetic acid molecule easily, acid molecules which are attracted to these positive electrodes, will pass this anion exchange membrane along the line of electric field force. As a result, acid is gathered between the anode and membrane, which is carried out by the flowing out of the electrolyte. In this way, acid will not accumulate excessively in the aqueous solution. Generally, acid is carried out excessively from the paint bath and acid in the bath rather tends to be depleted.

D.I. water is circulated in the first and second electrolyte circulation systems as a closed loop, and acid concentration starts to rise as the ED process continues. This will result in lowering the electric resistance of electrolyte (conductivity will rise). In this situation, the mentioned conductivity control circuit/unit is activated, namely if the conductivity of the electrolyte in first and second electrolyte circulation systems surpass the set conductivity values, then the conductivity control device will supply electrolyte with D.I. water as a dilution media. As the conductivity of the electrolyte will go down by the addition of D.I. water (electric resistance of electrolyte increase), the electric current to the first membrane electrode (high acid removal type of electrodes) will decrease and removal of acid will go down. By this the excessive extraction of acid from the bath paint is avoided, thereby helping to keep the acid concentration in proper level. At the same time, corrosion of the anode by acid is suppressed in each of these membrane electrodes which are connected to the first electrolyte circulation system.

By setting the conductivity of the second electrolyte circulation system at a high value, the conductivity of the electrolyte of the second electrolyte circulation system is kept on average higher (resistance is on average lower) than that of the first. Thus, the electric current flow to the electrodes connected to the second electrolyte circulation system (low acid removal type of membrane electrodes) becomes higher than the electric current flowing to the electrodes connected to the first electrolyte circulation system (high acid removal type of membrane electrodes). As a result, the membrane electrodes connected to the second electrolyte circulation system (low acid removal type membrane electrodes) are controlling the membrane electrodes connected to the first electrolyte circulation system (high acid removal type membrane electrodes), and by so doing it is effectively suppressing the extraction of excessive acid from the bath paint in the ED coating tank.

In accordance with the present invention, we also can propose such an arrangement that the first and second electrolyte control circuits/units each are provided with, correspondingly, first and second conductivity probes which monitor conductivity of the electrolyte of first and second electrolyte circulation systems, respectively, and first and second DI water supply devices to controllably add a desired or set amount of DI water, as dilution media, to the first and second electrolyte circulation systems, and a first and second D.I. water supply control part to send a signal to the first and second water supply devices when conductivity exceeds the pre-set conductivity reference value to activate the DI water supply devices, wherein the first and second D.I. water supply control parts have correspondingly first and second parts to set or change the conductivity reference value of activation.

In accordance with the present invention, it becomes possible, and gives advantage, not only to secure the stability of function of each electrolyte conductivity control, but also, in case acid is extracted excessively from the bath paint, to respond quickly to control the acid in the bath paint for a long time. Depending on the demands of the situation, the activation reference value of the second D.I. water control part can be changed with the second reference value setting part, thus changing the timing of D.I. water supply to the low acid removal type membrane electrodes which in turn changes the electric current that flows to the high acid removal type membrane electrodes, which in turn indirectly control the acid removal of high acid removal type membrane electrodes.

We can further propose such an arrangement that the first and second electrolyte circulation systems each correspondingly has first and second electrolyte tanks to hold a predetermined or set amount of electrolyte, piping between the first electrolyte tank and low acid removal type membrane electrodes and piping between the second electrolyte tank and high acid removal type membrane electrodes, and correspondingly first and second pumps and first and second valves built into this piping, wherein the first and second electrolyte circulation systems have correspondingly first and second control parts to control correspondingly the first and second pumps and valves, while each of the low acid removal type membrane electrodes and high acid removal type membrane electrodes preferably are grouped together through headers for electrolyte supply and return. In such a manner, the first and second electrolyte tanks and headers work as a flow buffer, and more efficiently maintain smooth circulation when there is some pressure difference in the different part of piping, or when air bubbles are trapped in the electrolyte flow.

Also in accordance with certain embodiments of the present invention, an arrangement may be provided in which a first electrode as an article to be coated is provided in an ED bath and a plurality of second electrodes are provided in association with the first electrode, wherein current is passed between the article to be coated and the second electrodes through an aqueous solution of a substance contained in the ED bath, to thereby electrodeposit the substance for forming a coating film onto the article to be coated, wherein each of the second electrodes comprises an electrode and membrane which separates the second electrode from the aqueous solution. In accordance with the present invention, some (e.g., a first group) of the second electrodes are low acid removal type electrodes, each being provided with corrosion resistant electrode material and first type membrane having a function of precluding most of the flow of ionized neutralizing agent in the aqueous solution from being extracted, and the rest (e.g., a second group) of the second electrodes being high acid removal type electrodes each being provided with a second membrane having a function of osmotically extracting the neutralizing agent. Each of the high acid removal type membrane electrodes preferably is provided with a first electrolyte circulation system to run electrolyte from one end to the other end between its second type membrane and electrode pipe, likewise each of the low acid removal type membrane electrodes is provided with a second electrolyte circulation system functioning basically the same as the first electrolyte circulation system, independently from the first system.

Further in accordance with embodiments of the present invention, the first electrolyte circulation system is provided with a first electrolyte conductivity control circuit/unit (e.g., control means), which functions to control the conductivity of circulating electrolyte solution by adding a quantity of D.I. water for dilution so to keep its electrolyte conductivity within a predetermined or set range, and the second electrolyte circulation system is provided with a second electrolyte conductivity control circuit/unit which functions to control conductivity of the second electrolyte below a set value by adding D.I. water when its conductivity exceeds a predetermined or pre-set reference value, and continue until the conductivity gets down below the predetermined or preset reference conductivity value. Further, in preferred embodiments of the present invention the pre-set activation reference value of the second electrolyte conductivity control circuit/unit is set greater than the maximum value of the conductivity range of first electrolyte conductivity control circuit/unit.

With such embodiments as disclosed herein, there is also an advantage of securing stable work of the control system. By providing the first electrolyte circulation system with the capability of setting a range of conductivity of electrolyte it can respond with a certain range of conductivity (range of tolerance) and avoid chattering which may occur when there was rapid change of up and down conductivity. As a result, such embodiments provide a capability to control acid concentration in the ED bath paint. In this case it is possible to provide, as with the case of the first electrolyte conductivity control circuit/unit, a second electrolyte conductivity control circuit/unit with capability to keep the conductivity of the electrolyte of the second electrolyte circulation system within a pre-set range of conductivity. In preferred embodiments, it is advisable, in this case, to set the maximum and minimum of the conductivity range set with the second electrolyte conductivity control circuit/unit greater than those of the first electrolyte conductivity control circuit/unit. In such embodiments, such a method provides the advantage of avoiding chattering of the second electrolyte conductivity control circuit/unit when the conductivity of the second electrolyte circulation system fluctuate up and down, resulting in improved overall stability of the system.

Further, in accordance with the present invention such arrangement that the first and second electrolyte control circuit/unit each has correspondingly first and second conductivity probes which monitors the conductivity of the electrolyte of the first and second electrolyte circulation systems, and first and second DI water supply devices to add a predetermined set amount of DI water, as dilution media, to the first and second electrolyte circulation systems, and first and second D.I. water supply control parts which work by a signal from the first and second conductivity probes and thereby control first and second water supply devices, and these first and second D.I. control parts each have the capability to adjust the maximum and minimum value of conductivity range or a reference value. In accordance with the present invention, such a method secures and improves an independent and trouble free supply of D.I. water to the electrolyte of the above mentioned first and second electrolyte circulation systems, resulting in smooth automatic conductivity control of electrolyte.

Also in accordance with the present invention, an arrangement may be provided in which a first electrode as an article to be coated is provided in an electrodeposition bath and a plurality of second electrodes are provided in association with the first electrode, wherein current is passed between the article to be coated and the second electrodes through an aqueous solution of a substance contained in the electrodeposition bath, to thereby electrodeposit the substance for forming a coating film onto the article to be coated, wherein the second electrodes comprise an electrode and a membrane that separates the electrode from the aqueous solution.

In preferred embodiments, some of the second electrodes are low acid removal type electrodes, each of which is preferably constituted with a corrosion resistant electrode material and membrane having a function of precluding most of the flow of ionized neutralizing agent in the aqueous solution from being extracted, and the rest of the second electrodes are high acid removal type electrodes each of which is provided with a second membrane portion having a function of osmotically extracting the neutralizing agent, wherein a number of low acid removal type membrane electrodes and high acid removal type of membrane electrodes are placed along the bath paint tank wall, and each of the high acid removal type membrane electrodes is provided with a first electrolyte circulation system to run electrolyte from one end to the other end between its second type membrane and electrode pipe, likewise each of the low acid removal type membrane electrodes is provided with a second electrolyte circulation system functioning the same as the first electrolyte circulation system, independently from the first system.

Then, a probe is provided in the ED bath tank to measure the acid concentration in the bath paint, and the first and second electrolyte circulation systems are provided with correspondingly, and independently from each other, first and second conductivity control circuits/units which are activated if conductivity in the ED bath paint becomes lower than a predetermined or set reference point to controllably introduce a desired or set amount of D.I. water to either the first or second electrolyte circulation system as a dilution media.

In accordance with such embodiments, further advantages are provided, such as quicker and more direct response to a drop of the acid concentration in the ED bath paint, as it directly monitors the acid concentration in the ED bath paint. In accordance with the present invention, we can propose such an arrangement that the first and second electrolyte control circuits/units each has correspondingly first and second conductivity probes, first and second D.I. water supply devices, which supply a controlled or set amount of D.I. water, as dilution media, to the first and second electrolyte and first and second D.I. water supply control parts which control first or second D.I. supply devices depending on the information from the acid concentration probe in the ED bath paint or from first or second conductivity probes, wherein each of the first or second D.I. water supply control parts is provided with first or second parts to set or change the desired reference value. With such embodiments, it becomes possible to automatically control the acid concentration in the bath paint quickly and with stability. At the same time it can control the conductivity of the first and second electrolyte circulation systems, so that degradation of anodes in the membrane electrodes connected to these electrolyte circulation systems will be avoided.

In certain embodiments, a modification of an ED coating system is provided where the membrane electrodes are installed along the ED coating tank wall in such a way that high neutralizer removal type membrane electrodes are placed in the upstream (first) zone where the article to be coated is brought in and generally a first, low voltage is impressed, high neutralizer removal type membrane electrodes and low neutralizer removal type membrane electrodes are placed mixed in downstream (second) zone where generally a second, higher voltage is impressed. For this reason, with such embodiments, because both high acid removal type membrane electrodes and low acid removal type membrane electrodes are placed mixed together, the change of conductivity of the electrolyte in the two type of membrane electrodes will influence mutually and directly. Namely, if D.I. water was added to the electrolyte of one of the two types of membrane electrodes, and thus the conductivity is reduced (resistance is increased), then the conductivity of the electrolyte of the other type of membrane electrodes is relatively increased (resistance is decreased).

For this reason, a relatively greater part of the electric current of the ED coating flows to electrodes with lower resistance than electrodes with higher resistance. In this particular case under discussion, a relatively greater part of the electric current flows to second membrane electrodes (low acid removal type membrane-electrodes) than first membrane electrodes (high acid removal type membrane-electrodes). As a result, acid removal from the bath paint is controlled effectively without changing the total electric current flow, and leads to smoother management of acid concentration in the bath paint.

Here, it is also possible, in the high voltage zone, to have placement of a number of two kinds of membrane-electrodes, from upstream where the generally lower voltage is impressed to downstream where the generally higher voltage is impressed, in such a way as, for example, a zone with low acid removal type membrane electrodes only, a zone in which both types are mixed, and finally a zone with high acid removal type membrane electrodes. In this way acid control is mainly done in the center of the ED tank, but the paint is constantly mixed and, for the paint in bath as a whole, acid removal is balanced. Particularly for the zone where the two types of membrane-electrodes are mixed, it is preferred to place the two kinds alternatively one by one, or two by two. In this way the electric current can be divided between low acid removal type membrane electrodes and high acid removal type membrane electrodes in a more ideal ratio, while keeping total current to a desired level in regard to the size of article to be coated, as the two kinds of membrane electrodes are placed close to each other and alternatively. As a result, it is possible to control the amount of acid removed from the bath paint by adding D.I. water to either of the two electrolytes.

In alternative embodiments, as basic system construction, an ED coating method is provided that includes a first electrode as an article to be coated provided in an ED bath and a plurality of second electrodes provided in association with the first electrode, wherein current is passed between the article to be coated and the second electrodes through an aqueous solution of a substance contained in the electrodeposition bath, to thereby electrodeposit the substance for forming a coating film onto the article to be coated, wherein the second electrodes include at least two types of electrodes, namely bare electrodes preferably made of a corrosion resistant material, and membrane electrodes made of an electrode and a membrane which separates the electrode from the aqueous solution. Some of said membrane electrodes are high acid removal type membrane electrodes, which comprises membrane that osmotically extract neutralizer ion in bath paint, wherein a number (i.e., plurality) of the bare electrodes and high acid removal type of membrane electrodes are placed along the ED paint tank wall. Preferably, each of the high acid removal type membrane electrodes are provided with a first electrolyte circulation system to run electrolyte from one end to the other end between its second type membrane and electrode pipe, wherein the first electrolyte circulation system is provided with conductivity control circuit/unit (e.g., means) that keeps the conductivity of electrolyte within a predetermined or set range.

Additional advantages of such embodiments of the present invention include the advantage of low initial investment cost and simpler maintenance, as such embodiments may utilize corrosion resistant bare electrodes, in place of a number of second membrane-electrodes. Here, we propose that the bare electrodes and high acid removal type membrane electrodes are installed along the ED coating bath tank wall in such a way; in preferred embodiments, high acid removal type membrane electrodes are placed in the upstream (first) zone where a generally low (lower) voltage is impressed, and give an area, in a downstream (second) zone, where generally a higher voltage is impressed, where high acid removal type membrane electrodes and bare electrodes are placed in a mixed manner.

In still other embodiments, it is possible to install the bare electrodes and high acid removal type membrane electrodes alternately in the downstream area where the generally higher voltage is impressed. Further, it is also possible to have the bare electrodes and high acid removal type membrane electrodes installed alternately two by two (or n by n) in the downstream area where the generally higher voltage is impressed.

BRIEF DESCRIPTION OF THE DRAWINGS

The present invention may be more fully understood by a description of certain preferred embodiments in conjunction with the attached drawings in which.

DETAILED DESCRIPTION OF THE PREFERRED EMBODIMENTS

The present invention will be described in greater detail with reference to certain preferred embodiments and certain other embodiments, which may serve to further the understanding of preferred embodiments of the present invention. As described elsewhere herein, various refinements and substitutions of the various embodiments are possible based on the principles and teachings herein.

First Preferred Embodiment

A detailed description will be provided of certain preferred embodiments of the present invention with reference to the drawings, primary FIGS. 1 through 8. Such a preferred embodiment as illustrated in FIGS. 1 to 8 generally correspond with a case when the present invention is applied with a cation ED coating system, where cation type paint is used.

Figure 1:
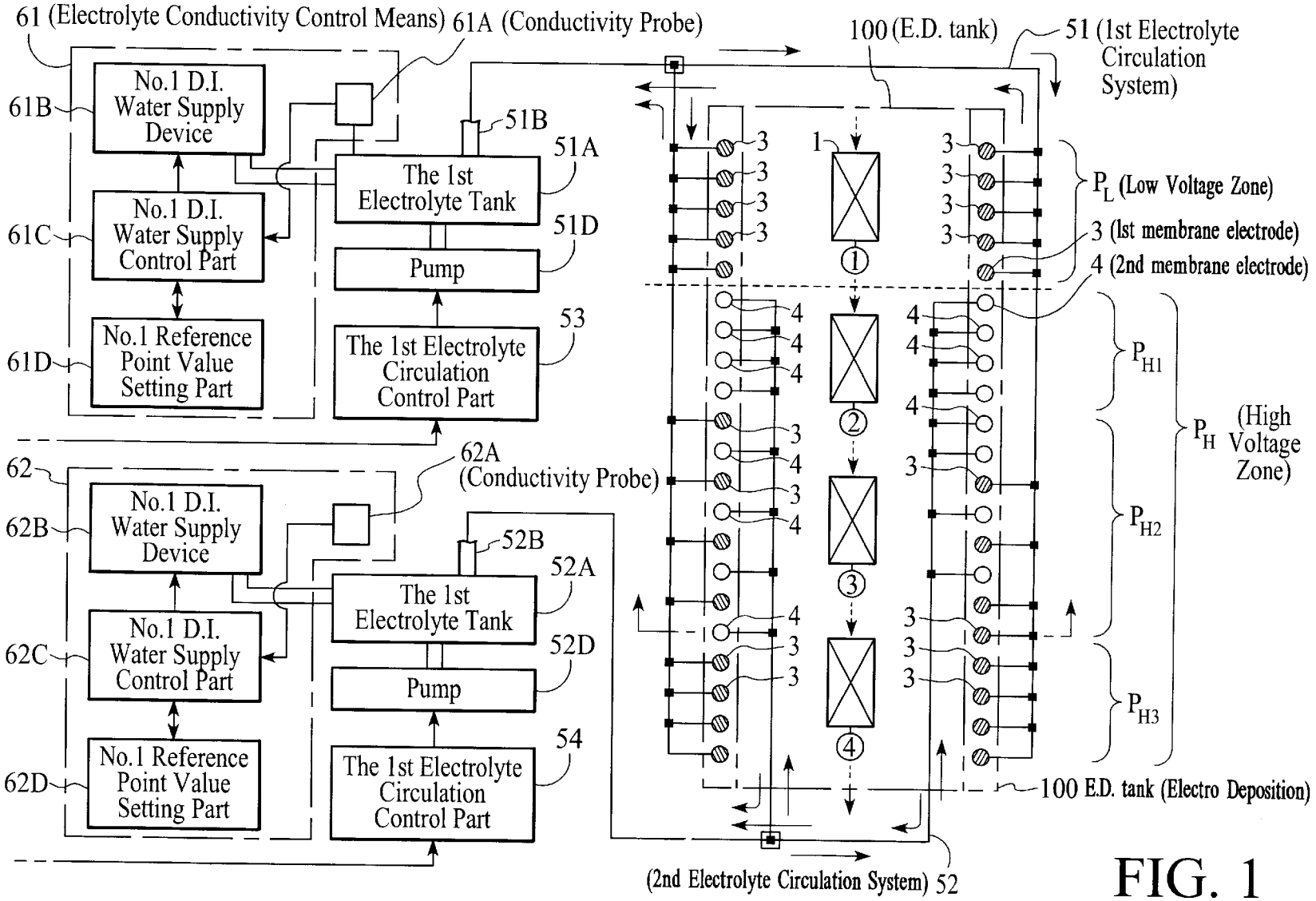
FIG. 1 is a concept diagram illustrating an outline of a first preferred embodiment in accordance with the present invention.
Figure 2:
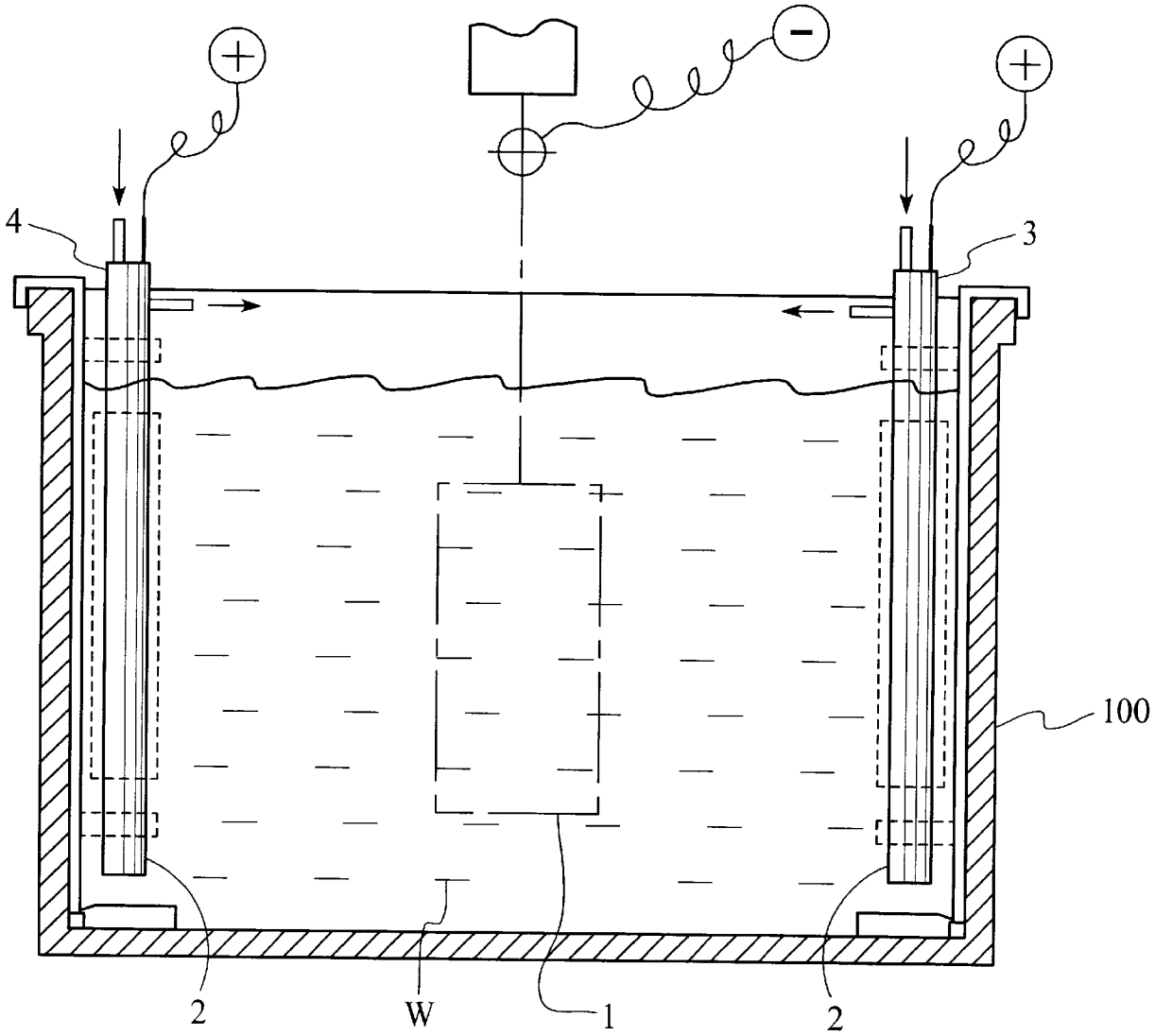
FIG. 2 is a drawing that illustrates a preferred positional relationship between first electrodes and second electrodes along the A—A line shown in FIG. 1.

Referring to FIG. 1, item 100 illustrates a ED bath tank, preferably having a shape like a narrow and long swimming pool. Within tank 100 is aqueous solution (cation type water base paint) W. Along the center line of tank 100 is indicated, as illustrated FIG. 2, the direction of movement of first electrode 1 as an article to be coated, from one end to the other end (from upstream to downstream). Item 2 illustrates second electrodes as opposed to the first electrode. Of the second electrodes 2 (more specifically explained later), there preferably are high acid removal type membrane electrodes 3,3,3, . . . , which include a second membrane to pass acid (for example anion exchange membrane), and low acid removal type membrane electrodes 4,4,4, . . . , which include a first membrane to preclude acid from passing (for example cation exchange membrane).

In an illustrative embodiment, the relative numbers of membrane electrodes used are 6 parts (e.g., n) of membrane electrodes 3 and 4 parts (e.g., m) of membrane electrodes 4. In other words, a preferably slightly greater number of high acid removal type membrane electrodes are used than low acid removal type. Membrane electrodes 3 and 4 are, as illustrated in FIG. 1, placed on both of the inside walls of ED tank 100. In this case, electrodes 3 and 4 are placed in such a way that, at the entrance side $P_L$ within ED tank 100, where article 1 is brought in and a low voltage is applied, high neutralizer removal type membrane electrodes 3 are found, while at the downstream side $P_H$ where higher voltage is applied are found both type of electrodes 3 and 4 with a certain mix ratio.

In this case, electrodes 4 and 3, which are installed in high voltage area $P_H$, are distributed, as illustratively shown in FIG. 1, from the upstream which is near the low voltage area $P_L$ to downstream, in such a way to form zone of $P_{H1}$, where low acid removal type membrane electrodes 4 are placed, zone $P_{H2}$, where a mixture of the two types of membrane electrodes 3 and 4 are placed, and zone of $P_{H3}$, where mostly type membrane electrodes 3 are found. These placements are desirably utilized in the process of ED coating in accordance with the present invention. There will be a further discussion on the voltage impression of low voltage zone $P_L$ and $P_H$ elsewhere herein.

As a high acid removal type of membrane electrodes 3, such membrane electrodes preferably are used with a membrane that osmotically extracts neutralizer of bath paint W (cation type aqueous solution) contained in tank 100. Also, as low acid removal type membrane electrodes 4, such membrane electrodes are used as with tubular anode of corrosion resistant material (for example titanium on which iridium oxide is coated, or conductive ferrite), and with a first type of membrane that preclude (i.e., do not pass) most of the acid ions in the aqueous solution W that are attracted toward this tubular anode.

Figure 3:
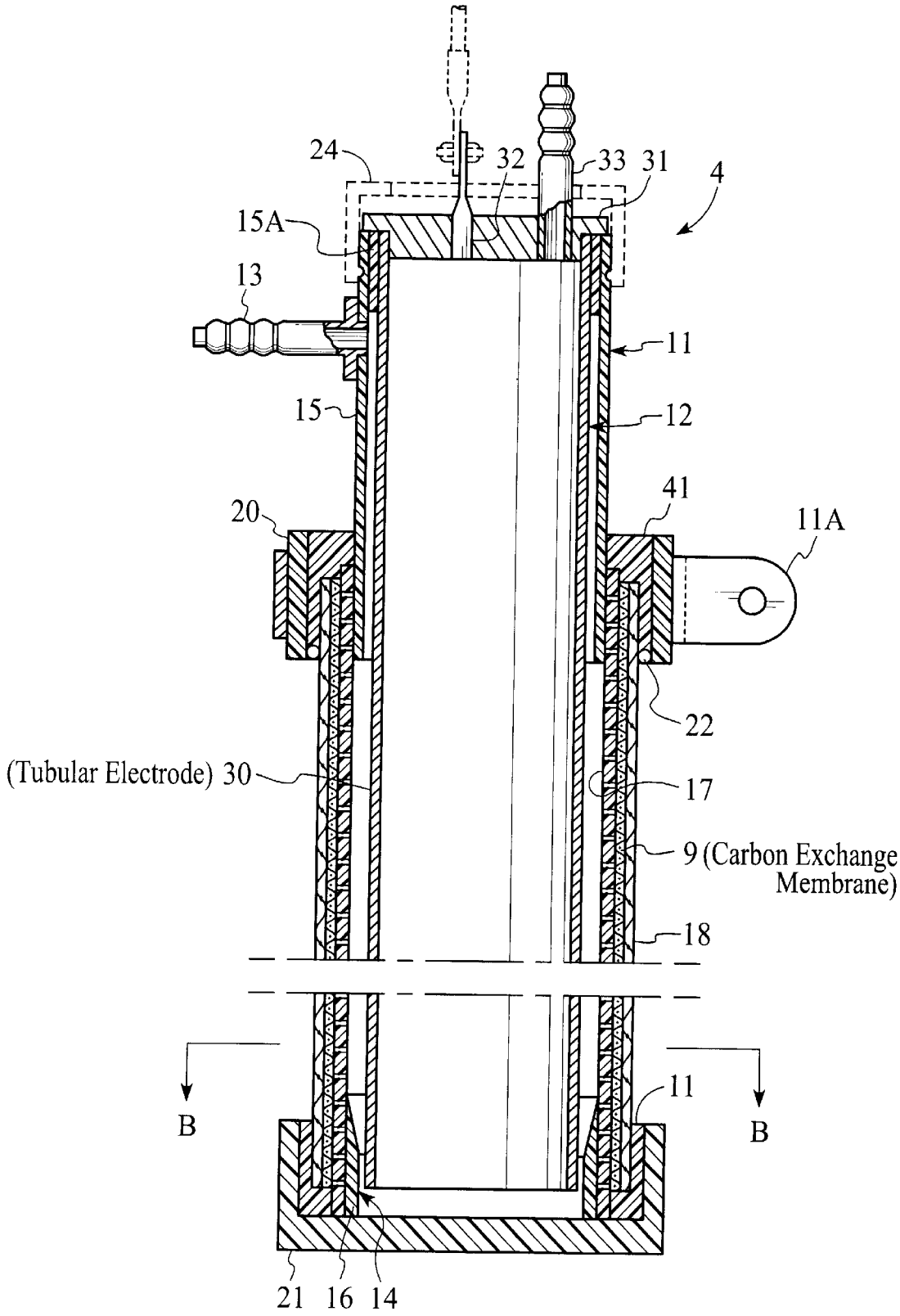
FIG. 3 illustrates one example of a second electrode as illustrated in FIG. 1.
Figure 4:
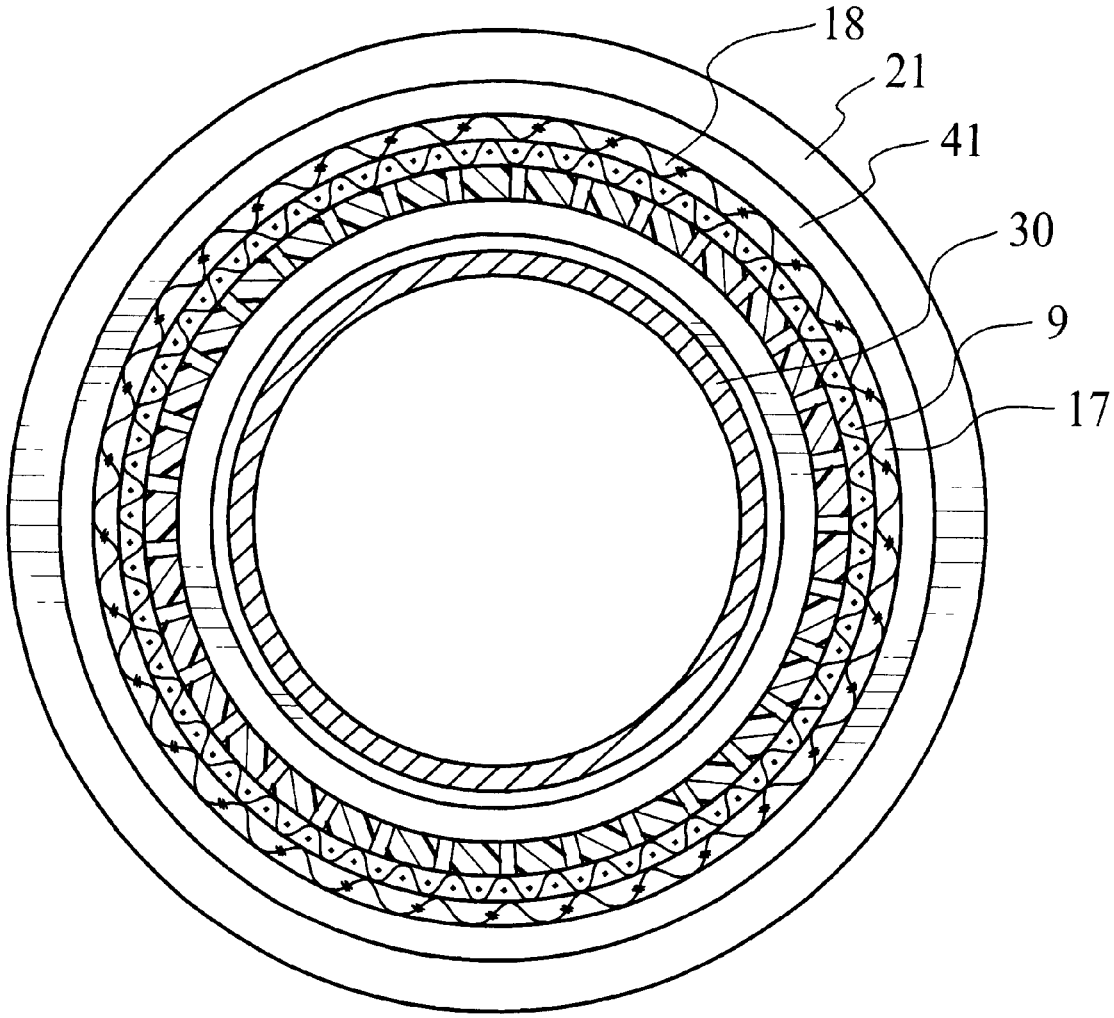
FIG. 4 illustrates a crosscut section of FIG. 3 along B—B line.
Figure 5:
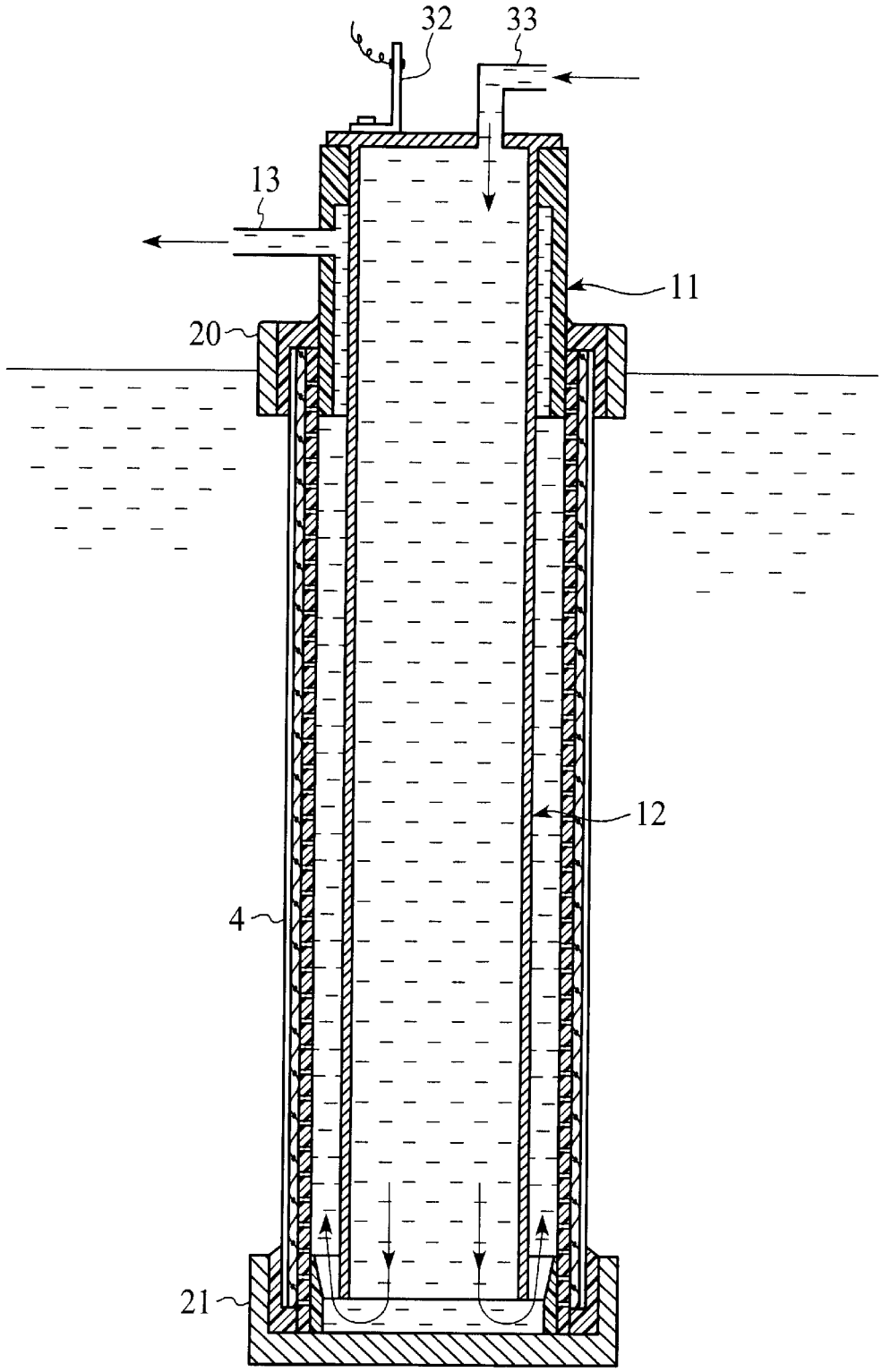
FIG. 5 illustrates a flow of electrolyte in the second electrodes as opposed to the first electrodes, which is referenced in FIG. 1.

More detailed explanation will now be provided regarding membrane electrodes 3 and 4. It should be noted, however, that in other embodiments other types of membrane electrodes may be used in accordance with the present invention. First begin with electrode 4. Electrode 4 preferably comprises, as illustrated in FIGS. 3 to 4, main body 11, internal electrode 12, and water running structure 14, which desirably causes flow in the space created between body 11 and electrode 12. Main body 11 preferably consists of first and second insulation pipes, 15 and 16, separated from each other with a predetermined or suitable distance and aligned coaxially, membrane support tube 17 that joins pipes piece 15 and 16, first type membrane as cation exchange membrane 9 which is wound around the support tube 17, and protective cloth 18 which wrap around the membrane 9. As this protective cloth, synthetic cloth with necessary strength, durability and water permeating character preferably is used.

Membrane support tube 17 is made of electrically insulative material, preferably with net-like opening, or of porous material formed into a long tube and joined together with insulative pipe 15 and 16 at their inner surface. Cation exchange membrane 9 preferably is made into tubular form and placed over the outer surface of membrane support tube 17. Cation exchange membrane 9 is structurally reinforced against pressure from outside as it rests on membrane support tube 17. On the outside of cation membrane 9 preferably is protective cloth 18 wound around it spirally over the entire length, and therefore is sufficiently reinforced against the inner pressure also.

On both ends of membrane support tube 17, on which is laid cation exchange membrane 9 and protective cloth 18, are first and second frames 20 and 21 separated by a distance, and potting material 41 is filled, thus all the components such as, insulative pipe 15 and 16, membrane support tube 17, cation exchange membrane 9, protective cloth 18 are securely assembled into one piece. Here, first frame 20 is shaped tubular and at the time of filling the potting material a ring 22 is put inside of frame 20 to prevent the running down of the potting material. Second frame 21 is made into cup form into which are inserted membrane support tube 17 and insulator tube 16, etc., and they are joined together into one embodiment by potting material 41. As a potting material, epoxy resin is used in this example but urethane resin or phenol resins also may be used.

In this exemplary embodiment, hard PVC tube is used as first and second insulator tubes 15 and 16. Over-flow nozzle 13 preferably is provided on first insulator tube 15 as illustrated FIG. 3, and on the top is cover 24, which is easily put on or taken off, such as with a snap or screw mechanism or the like. Item 15A illustrates a spacer piece preferably attached as illustrated.

Internal electrode 12 preferably is a tubular electrode 30 made of titanium material on which is an iridium-oxide coating, and also preferably included is suspending stopper piece 31 that is attached to the top of this electrode, and further of electrical terminal 32 and electrolyte supply nozzle 33 connected on top of this electrode. The outer diameter of this tubular electrode 30 is made smaller than the inner diameter of insulator pipes 15 and 16. As a result, insertion and removal of this tubular electrode is easily done while a part of water running space 14 is created between main body 11 and tubular electrode 11. Suspending stopper 31 preferably is made of metal, and its outer diameter is greater than that of tubular electrode 30 and extends outward, and as illustrated in FIG. 3 it is caught by and rests on the top of insulator tube 15. In such a manner, internal electrode 12 can be easily inserted in place and easily taken out as the need may occur.

Water running space 14 serves to flush out acid such as acetic acid which accumulates between cation exchange membrane 9 and tubular electrode 30, and actually this space is formed by internal electrode 12 and main body 11. Namely, the D.I. water which is supplied through supply nozzle 33 located on top of internal electrode 12 flows downward inside of tubular electrode piece 30, as indicated by the arrow in FIG. 5 (cross section view of drawing No. 3), then at the bottom end flows toward outside of tubular electrode piece 30, then flows upward along the outside of tubular electrode piece 30 and inside of cation exchange membrane 9, finally flow out of overflow nozzle 13 with impurities. In other embodiments, other water flushing implements may be utilized, such as having a supply tube down the space between the inner electrode and the main body, with the water then flowing up and out of the overflow nozzle. Other types of water supply and membrane-electrode structures utilizing an anolyte supply of the general type describe herein also may be utilized in accordance with certain embodiments of the present invention, although the preferred embodiments are constituted as illustrated in the figures.

Hanging clamp 11A is provided around frame 20, which is one of the two frames on main body 11, and serves for hanging the membrane electrode assembly on an ED coating tank wall. Protective cloth 18 which covers the outside of cation exchange membrane 9 need not be necessarily a cloth but alternatively may be any suitable material having the required strength and water permeability. The cation exchange membrane can be wound around the support tube with seams sealed, or made tubular form first before it is laid over support tube, or in other suitable forms.

First membrane electrode (high neutralizer removal type membrane electrodes) 3 is constructed in the same manner as second membrane electrode (low neutralizer removal type membrane electrodes) 4 except an anion exchange membrane as the membrane is used in place of cation exchange membrane 9. Also, as tubular electrode piece 30, ordinary stainless steel preferably is used. The remaining portions in general may be constituted in the same manner as membrane electrodes 4.

The space (water running space) between the second membrane (anion exchange membrane as example) of the high neutralizer removal type membrane electrode 3 and electrode material is connected to first electrolyte circulation system 51 to force water flow from one end to the other end. Also the space between the first membrane (cation exchange membrane) of the low neutralizer removal type membrane electrode 4 and electrode piece is connected to second electrolyte circulation system 52 to function the same way as the first electrolyte circulation system 51 but preferably separated from it (so as to be independently controllable, as described herein, etc.).

Items 53 and 54 each correspondingly illustrate first and second electrolyte circulation control parts, which control the function of first and second electrolyte circulation system 51 and 52. The first and second control parts of electrolyte circulation system 53 and 54 are activated or inactivated, by one or more signals from main control part 200 (see FIG. 8), which is explained later. First electrolyte circulation system 51, as illustrated in FIG. 6, preferably consists of first electrolyte tank 51A which contains up to a set or desired amount of solution, piping 51B which makes up a circulation path between electrolyte tank 51A and the membrane electrodes (high neutralizer removal type) 3, valves 51C1 and 51C2, and pump 51D, built in this piping such as is illustrated.

Electrolyte circulation control part 53 controls valves 51C1, 51C2 and pump 51D and through this has the capability to control the flow rate of electrolyte or start/stop of circulation. Also, piping 51B of first electrolyte circulation system 51 preferably consists, as illustrated in FIG. 6, of solution supply pipe 51B*a* and return pipe 51B*b*, and make up electrolyte circulation loop between electrolyte tank 51A and membrane electrodes 3. Items 55*a* and 55*b* illustrate pipe connectors.

Figure 6:
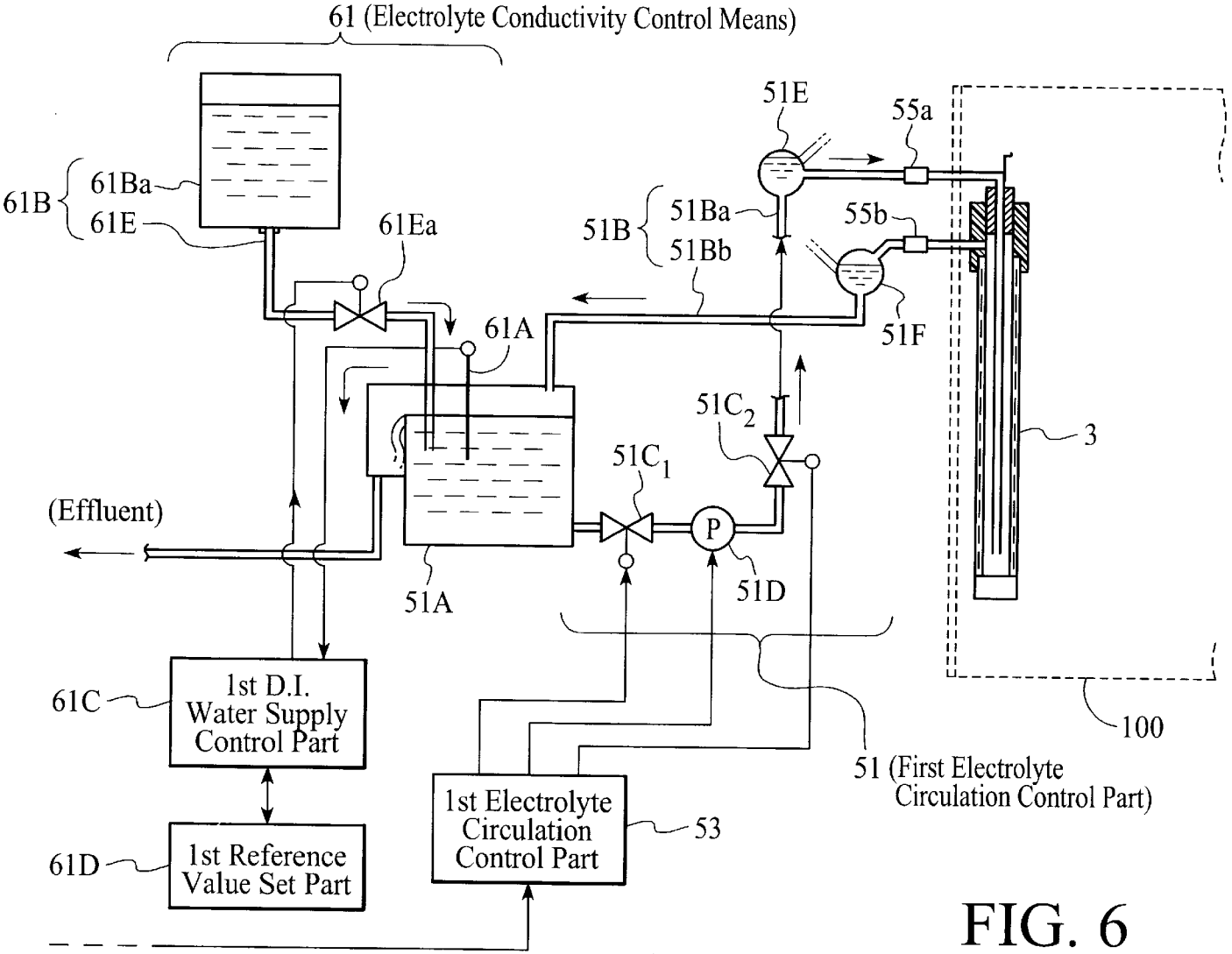
FIG. 6 is a concept drawing illustrating first electrolyte circulation system and first electrolyte conductivity control means of FIG. 1.

In FIG. 6, item 51E illustrates a electrolyte supply header which is installed at the branching point of supply pipe 51B*a*. Item 51F illustrates a electrolyte return header which is installed at the branching point of electrolyte return pipe 51B*b*. Each of headers 51E and 51F is made of appropriate size and capable of storing a desired certain amount of inflow solution for a suitable time. For this reason, each header 51E and 51F works as a damper for pressure fluctuation, and also as an air bubble releaser.

Second electrolyte circulation system 52 as illustrated in FIG. 1 preferably is constructed in the same manner as the above-mentioned first electrolyte circulation system 51, and thus consists, as illustrated in FIG. 1, of electrolyte tank 52A, piping 52B which make up a circulation path between electrolyte tank 52A and membrane electrodes 4, and pump 52D built in piping 52B. Also, second electrolyte circulation control part 54 has, like the above-mentioned first electrolyte circulation control part 53, the capability to control valves (not expressly shown) and pump 52D in an analogous manner.

Further, as illustrated in FIGS. 1 and 6, first electrolyte circulation system 51 and second electrolyte circulation system 52 correspondingly have first and second electrolyte conductivity control means 61 and 62, which regulates the electrolyte's conductivity of electrolyte circulation systems 51 and 52. In preferred embodiments, of the two electrolyte conductivity control means, the first electrolyte conductivity control means 61, has the first conductivity sensor 61A which monitors the conductivity of the electrolyte of first electrolyte circulation system 51, and first D.I. water supply device 61B, which supplies D.I. water, as dilution media, to first electrolyte circulation system 51, depending on and in response to information from first conductivity probe 61A, and first D.I. water supply control part 61C, which controls the first D.I. water supply device 61B, and first conductivity reference value setting part 61D to set the reference conductivity or the maximum and minimum of a suitable or desired conductivity range. This conductivity reference value or range is set by setting part 61D such as by an operator, directly through switches or dials or the like or through electronic or computer control. Item 61E illustrates a D.I. water supply pipe. Here, first D.I. water supply device 61B consists of D.I. water holding tank 61B*a* and D.I. water supply pipe 61E which supply D.I. water from D.I. water holding tank 61B*a* to electrolyte tank 51A. D.I. supply pipe 61E is provided with valve 61E*a* and is controlled by first D.I. water supply control part 61C at a proper timing.

Explanation will now be provided with respect to the function of the above-mentioned first D.I. water supply control part 61C. Two reference conductivity values Eu, EL (Eu>EL) are stored in the memory of first D.I. water supply control part 61C. These two values preferably are entered in by operator or otherwise as mentioned previously. In this case, the reference value of Eu, EL are the maximum and minimum value of conductivity allowed in the electrodeposition-coating tank, and may be determined by appropriate testing for the particular paint, water, system, etc. First D.I. water control part 61C preferably is provided with the capability of controlling D.I. water supply by driving D.I. water supply device 61B, which is activated when the conductivity value Es is found to be greater than the set reference value Eu (Eu>EL). Here, first D.I. supply control part 61C provides the function of manipulating first D.I. water supply device 61B and stop D.I. water supply when, after the D.I. water supply has started, the electrolyte conductivity Es drops below the lower reference value EL.

Figure 7:
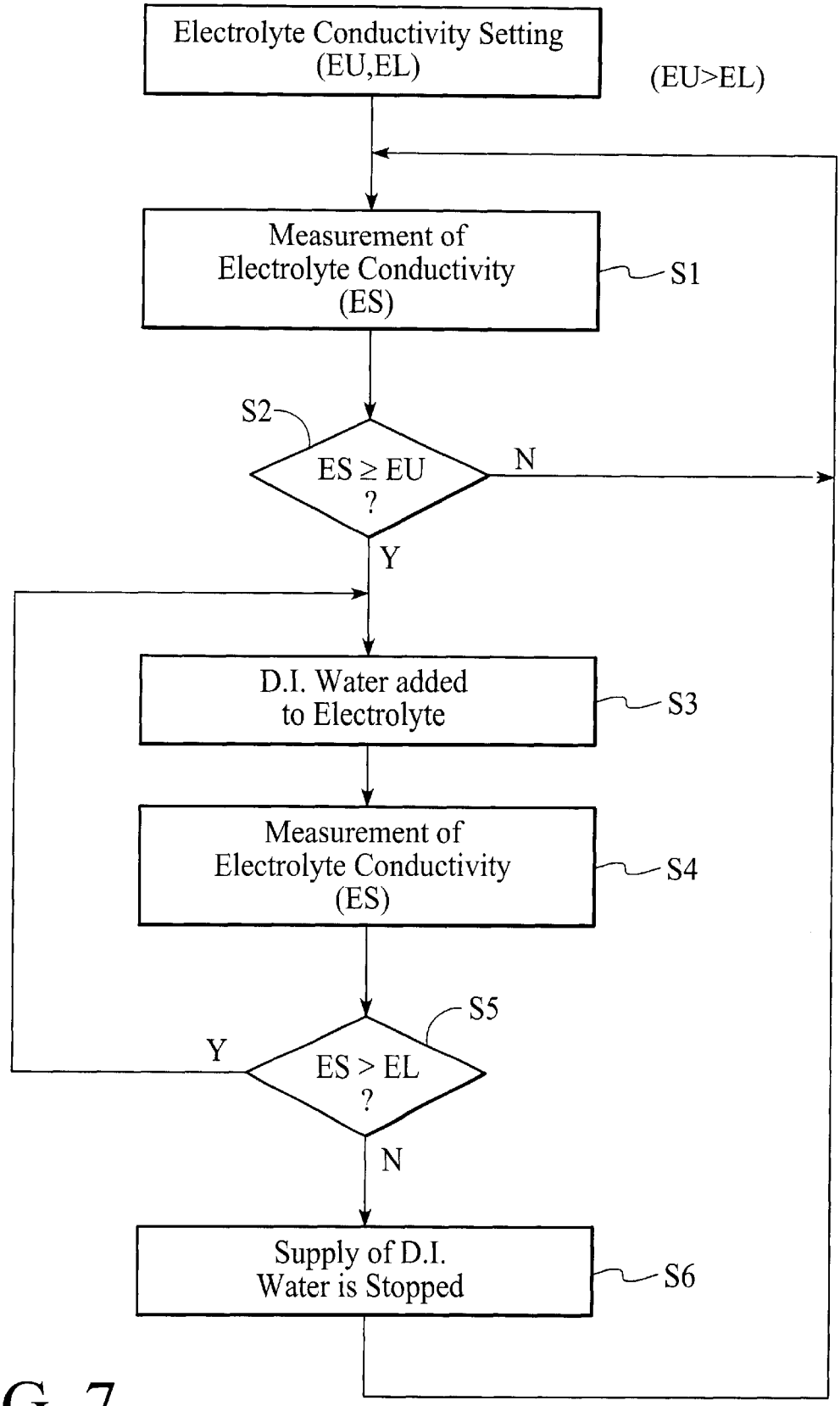
FIG. 7 is a logic flow chart illustrating the function of first D.I. water supply control part in first electrolyte conductivity control means, as illustrated in FIG. 1.

Further detailed explanation will now be given. As illustrated in FIG. 7, this first D.I. water supply control part constantly monitors, using the information from conductivity probe 61A, if the electrolyte's conductivity Es is greater than the upper reference conductivity value Eu (steps s1 ,s2 in FIG. 7). If Es is equal to or greater than Eu, then preferably it immediately activates the D.I. water supply device, and supplies D.I. water to first electrolyte tank 51A (step s3 of FIG. 7). On the other hand, if Es<Eu, then it continues to monitor information from conductivity monitor.

Further, first D.I. supply control part 61C, during the supply of D.I. water to first electrolyte tank 51A, continues to monitor information from conductivity monitor 61A, and judges whether or not the electrolyte's conductivity Es is greater than lower reference value EL (steps s4, s5 of FIG. 7). If Es>EL, it continues the supply of D.I. water. On the other hand, if Es<=EL, it preferably immediately controls first D.I. water supply device 61B to stop the supply of the D.I. water to first electrolyte tank 51A, (step s6 of FIG. 7) and again continues to monitor the information from first conductivity probe 61A (step s1 of FIG. 7).

By repeating the same process, acid concentration of solution in electrolyte tank 51A is kept within the set range, and so the amount of acid taken out of ED bath 100 is intermittently restricted. In this case the supply of D.I. water is carried out by opening and closing of valve 61D*a* by first D.I. water supply control part 61C.

Second electrolyte conductivity control mean 62, just like the first electrolyte conductivity control mean 61, is also provided correspondingly with conductivity probe 62A which measures conductivity of electrolyte of second electrolyte circulation system 52, D.I. water supply device 62B, which supplies D.I. water as a dilution media to second electrolyte circulation system 52 depending on the information supplied by second conductivity probe 62A, second D.I. water supply control part 62C, which controls the second D.I. water supply device 62B, and the second reference value setting part 62D, which is included in this second D.I. water supply control part and through it the reference values of the maximum and minimum conductivity values of the conductivity range can be entered. As illustrated, it preferably may be implemented in the same or almost the same manner as first electrolyte conductivity control means 61.

Here, in this embodiment example, the second conductivity reference values and range according to which second electrolyte control means 62 acts to supply D.I. water to second electrolyte circulation system 52, is set generally larger (or higher) than the first conductivity reference values and range according to which first electrolyte control mean 61 acts to supply D.I. water to first electrolyte circulation system 51. For example, for the first electrolyte conductivity control means, the reference value preferably may be set 480 to 520 micro Semens/cm, or 500 to 800 micro Semens/cm. These values are entered or changed by an operator through first reference value setting part 61D as discussed previously. On the other hand, for second electrolyte conductivity control means 62, reference values preferably may be set 1200 to 1400 micro Semens/cm, or 1600 to 1800 Semens/cm. These values are also entered or changed by operator through second reference value setting part 62D as discussed previously.

In this manner, by setting the conductivity of second electrolyte circulation system 52 high through second electrolyte control means 62, the electrolyte conductivity of second electrolyte circulation system 52 becomes higher with time (resistance becomes lower) than the electrolyte conductivity of first electrolyte circulation system 51, and because of this by setting membrane electrodes 3 and 4 near to each other in ED tank, the electric current to low neutralizer removal type electrode 4 which is connected to second electrolyte circulation system 52 becomes greater than high neutralizer removal type electrodes 3 which is connected to first electrolyte circulation system 51. Namely, in comparison between electrodes 3 and 4, current flowing to low neutralizer removal type membrane electrodes 4, which is connected to second electrolyte circulation system 52, becomes greater on a time averaged basis, and at the same time electric current flowing to high neutralizer removal type membrane electrodes 3, which is connected to first electrolyte circulation system 51 becomes low on a time averaged basis. This means that the low neutralizer removal type membrane electrodes 4 is suppressing the acid removal by high neutralizer removal type membrane electrodes 3, and in this way excessive removal of acid from aqueous solution in ED tank 100 is effectively prevented, with normal coating operation.

On the other hand, under such circumstance, if the acid concentration in aqueous solution in ED tank increased, DI. water is supplied in the second electrolyte circulation system 52 which is connected to low neutralizer removal type membrane electrode 4. By so doing, the resistance of electrolyte in second electrolyte circulation system 52 will increase, and in comparison the resistance of the electrolyte of first electrolyte circulation system 51 will become relatively lower, and if membrane electrodes 3 and 4 are near to each other the electric current to membrane electrode 3 will increase and removal of acid will increase, and in the end acid in aqueous solution in ED tank 100 is effectively extracted into first electrolyte circulation system 51.

So far, electrolyte conductivity control means 61 and 62 for correspondingly the first and second electrolyte had each two conductivity reference values to set each conductivity range, it can be that each has only one reference value. It is also possible that either of electrolyte conductivity control means 61 and 62, for correspondingly first and second electrolyte circulation systems, has only one reference value and the other has two, etc.

Figure 8:
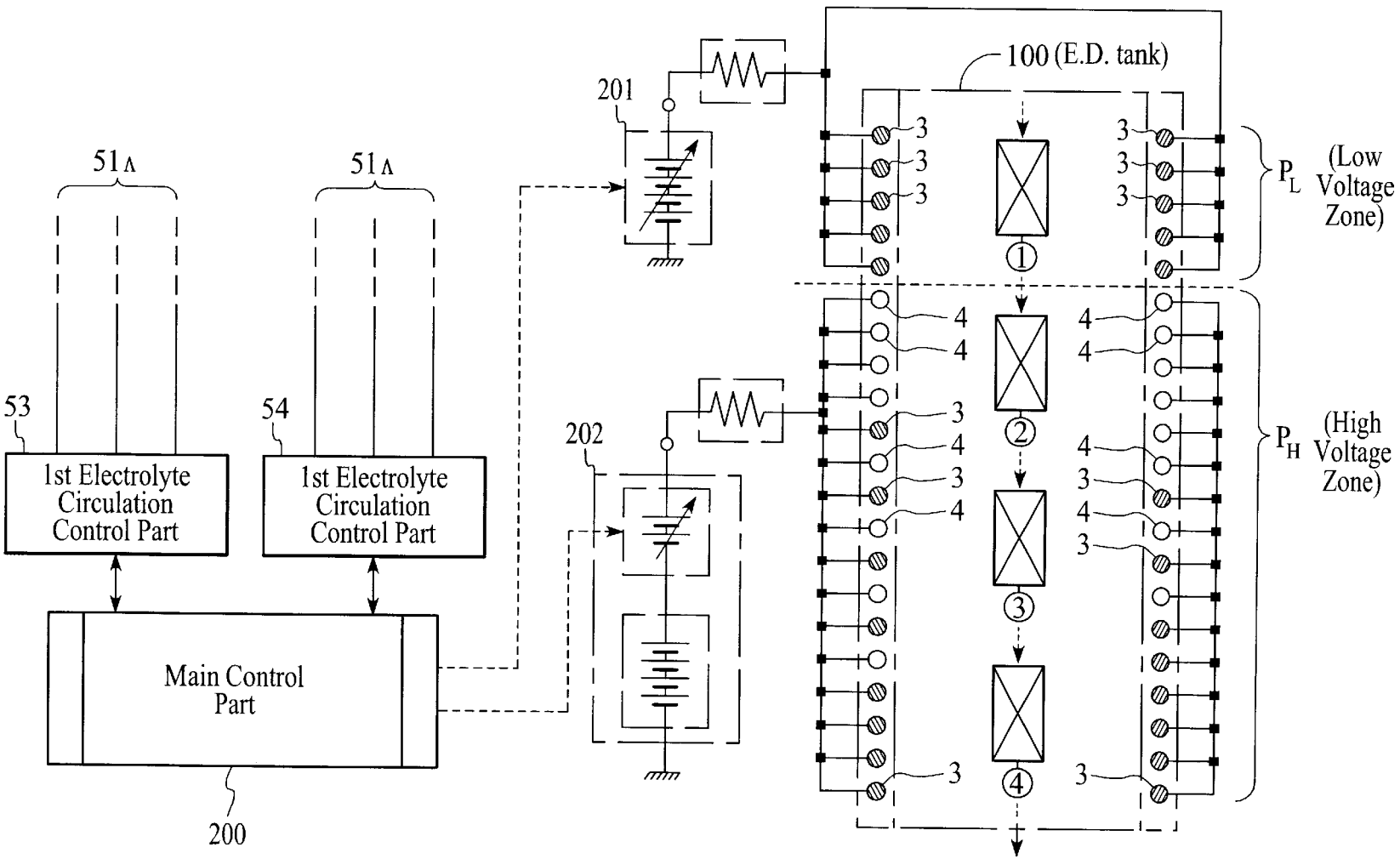
FIG. 8 illustrates placement of first and second type membrane electrodes, and relationship with power sources.

Next, an explanation will be given regarding electric circuitry of a power source in relation to first and second membrane electrodes, based on FIG. 8. First and second membrane electrodes 3 and 4 are, as illustrated in FIGS. 1 and 8, placed in ED tank 100 in such a way that mostly high neutralizer removal type membrane electrodes 3 are placed in the upstream zone ($1^{st}$ zone) $P_L$, where the articles to be coated are preferably in serial fashion brought in and a low voltage is applied, and in the downstream zone ($2^{nd}$ zone) $P_H$, where a high voltage is applied, both high and low neutralizer removal type membrane electrodes, 3 and 4, are placed. Here, each of membrane electrodes 4 and 3 which are placed in the second zone (high voltage zone) $P_H$, as illustrated in FIGS. 1 and 8, from upstream which is close to the first zone (low voltage zone) $P_L$ to downstream, in such an order that in first sub-zone $P_{H1}$ low neutralizer removal type membrane electrodes 4 are placed, then in second sub-zone $P_{H2}$ both high and low neutralizer removing type membrane electrodes 3 and 4 are placed in a mixed manner, and finally in sub-zone $P_{H3}$ mostly high neutralizer removal type membrane electrodes 3 are placed, making ideal arrangement with the flow of work.

Membrane electrodes 3 in first zone $P_L$ are connected to a first power source for low and preferably variable voltage output 201 in parallel. First power source 201 can produce voltage from 20 to 300 volts continuously rising, and preferably it is capable of so-called soft starting. At the initial stage, when the film has just started to build on the surface of the article to be coated, the resistance of the film is low, so the voltage impressed is controlled to be low to give controlled current flow, thus resulting in good film formation. First low voltage power source 201 is made to work well under such circumstance.

Membrane electrodes 3 and 4 in second zone $P_H$ are connected to second power source 202, and preferably regardless of whether type 3 or 4 about 300 volts is impressed to both types of membrane electrodes. Second power source 202 is also capable to produce any desired voltage, but preferably is not capable of soft starting. Both power sources 201 and 202 preferably are controlled by the command from main controller 200.

Next, an explanation will be provided with respect to the overall function as an entire coating system in actual practice.

An article to be coated is connected to a negative pole, and tubular electrodes 30 inside of first type membrane electrodes (high neutralizer removal type) 3,3,3, . . . , and second type membrane electrodes (low neutralizer removal type) 4,4,4, . . . , are connected to a positive pole. As soon as direct current is applied in this arrangement, immediately ED coating will start, both resin and pigment colloids having positive ion charge are attracted to the article to be coated 1 with negative polarity, and deposited on the surface of article 1 as the positive charge is discharged. This stage corresponds with article 1 in the position of the first zone $P_L$ of FIGS. 1 and 8.

As anion exchange membrane, which pass negatively charged acetic acid, is used with first membrane electrodes 3, acetic acid ion is attracted to positively charged tubular electrode material 30 of membrane electrodes 3. Acetic acid ions easily pass through anion exchange membrane along the electric line of force, reach the electrode and discharge. These neutralizer molecules after being discharged, in low concentration, are all dissociated and ionized, so are attracted to the positive electrode during the time when the current is on. As a result, acetic acid molecules are accumulated between tubular electrode material 30 and the anion-exchange membrane. Thus in the aqueous solution (cation ED paint) in ED tank 100, the portion of neutralizer, acetic acid, which is left behind as the result of film formation, is removed effectively by membrane electrodes 3 so that acid balance is kept.

At this point an explanation of the electric path under such circumstance in the aqueous solution will be provided.

As the electric resistance of the aqueous solution in ED tank 100 is comparatively high, the main current path is made between article to be coated 1 and closest membrane electrode 3 (or 4). Namely, when article to be coated 1 is in position (1) of FIGS. 1 and 8, 9, mainly the membrane electrodes in zone shown A in FIG. 9 (the $2^{nd}$ and $3^{rd}$ from top on both sides) will provide a current path to article 1. Membrane electrodes 3 placed before and after zone A (1st and $4^{th}$ from top on both sides) form a weak path to article 1 as the distance is greater to article 1. While article 1 is in first zone (low voltage zone) $P_L$ (position (1) in FIGS. 1 and 8), film is rapidly formed on the surface of article 1, while acetic acid molecules as neutralizer are released rapidly and the quantity of it is increased in ED tank 100.

On the other hand, the removal of acid is done by membrane electrodes 3, which form the current path to article 1. In other words, in the same time as the film is formed on the surface of article 1, acetic acid as neutralizer is extracted by membrane electrode 3 which is making current path to article 1. In this case, acetic acid is extracted efficiently as the membrane of membrane electrode 3 is high acid removal type. As mentioned before, electrolyte is flowing between tubular electrode material and anion-exchange membrane and accumulated acetic acid is continuously flushed out.

Next, a discussion will be made of when the article to be coated 1 is in the second zone (high voltage zone) $P_H$ in the FIGS. 1 and 8. Positions (2),(3),(4) in FIGS. 1 and 8 correspond to this case.

Figure 9:
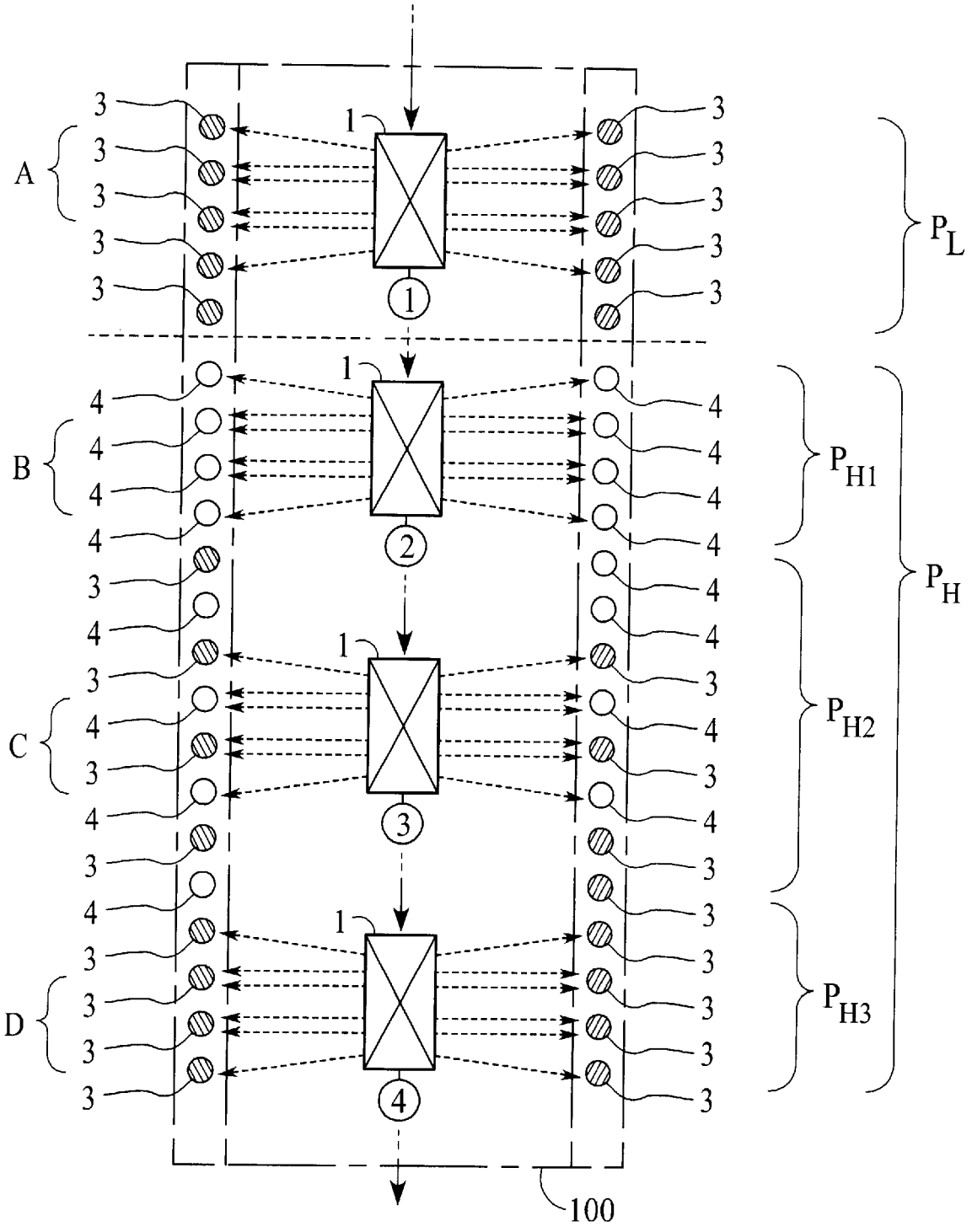
FIG. 9 is a drawing used to explain the function of current flow in preferred embodiments shown in FIG. 1.

First, when article 1 is in the position of (2) (high voltage zone $P_{H1}$) of FIG. 8, second membrane electrodes 4 are found and therefore extraction of acetic acid in aqueous solution is suppressed. In this case, as illustrated in FIG. 9, membrane electrode 4 in the zone marked B (the $2^{nd}$ and $3^{rd}$ electrodes from top in high voltage zone $P_{H1}$) will make a current path with article 1. Electrodes 4 in the same zone but before and after zone marked B ($1^{st}$ and $4^{th}$ in the high voltage zone $P_{H1}$) will make only a weak path as the distance is greater. Second membrane electrodes 4 have cation-exchange membrane 9 preferably with removal efficiency of less than $1\times10^{-6}$ mole/Coulomb. For this reason, flow of acetic acid ions in the aqueous solution W is precluded by this cation exchange membrane 9 and cannot reach tubular form electrode 30, therefore acetic acid is left in aqueous solution W in ED tank 100.

At this point, the current path between article 1 and membrane electrodes 3 located in first zone (low voltage zone) $P_L$ is extremely weak. This is because the aqueous solution W has considerably high resistance, and the current path is made mainly with membrane electrodes 3 and 4 which are closest (with least resistance) to article 1. While article 1 is in position (2) of FIGS. 1 and 8 (high voltage zone $P_{H1}$), negative ions cannot move from aqueous solution W to tubular form electrode 30. However, hydrogen ions created as the dissociation of acetic acid already accumulating in the space between tubular form electrode 30 and cation exchange membrane 9 are attracted toward article 1 and pass through cation exchange membrane. As a result, hydrogen ions carry positive charge and electric current can flow. In this manner, an electric path can form between article 1 and membrane electrode 4 just like between article 1 and membrane electrode 3, and ED coating continues smoothly.

In addition, even membrane electrode 4 with cation exchange membrane 9 will not completely stop the acetic acid, as mentioned above, and a small amount of acetic acid ions will reach tubular form electrode 30 and discharge. As described earlier, these acetic ions will accumulate in the space between tubular form electrode and membrane 9, which is flushed out with electrolyte. In this example, the tubular form electrode of the second membrane electrode preferably is made of titanium on which surface an iridium oxide coating is applied, and as a result there tends to be few heavy metal ions released.

Next, a discussion will be provided when article 1 reaches to position (3) in the second zone (high voltage zone) $P_{H1}$. In this case, as illustrated in FIG. 9, electrodes in zone marked as C ($4^{th}$ and $5^{th}$ from top in high voltage zone $P_{H2}$) will work and an electric path is formed between article 1 and membrane electrodes 4 and 3. As for membrane electrodes 3 and 4 located upstream and downstream of the zone marked C ($3^{rd}$ and $6^{th}$ in high voltage zone $P_{H2}$), in the same drawing, only a weak path is formed because the distance is greater.

Although when article 1 comes to this point (zone $P_{H2}$), the consumption of film forming material in the aqueous solution decreases, and the acid extraction continues with membrane electrodes 3 and 4. The overall effect of this is that excessive acid extraction occurs, and acid concentrations in the aqueous solution W in ED tank 100 decreases. Under such circumstance, as for example with high neutralizer removal type electrode 3, an increase of concentration in first electrolyte circulation system is sensed. Immediately, electrolyte conductivity control means 61 will respond, and D.I. water is supplied to the electrolyte of membrane electrodes 3 resulting in an increase of resistance of electrolyte of membrane electrodes 3 and suppress the extraction of acid.

By the addition of D.I. water to the electrolyte of membrane electrode 3, its resistance increases, and momentarily suppresses the flow of ions to membrane electrode 3. As D.I. water addition will not occur at the same timing to membrane electrode 4, the flow of ions will tend to move to nearby electrodes 4. This is because, as explained, the electric resistance of aqueous solution in ED tank is comparatively high and electric current always passes through the shortest path (path with least resistance). For this reason, ED coating proceeds smoothly without problem as a whole or as seen locally. In this case, although the flow of ions increases to membrane electrode 4, this low neutralizer removal type membrane electrode has extremely low acid removal, and there is little change in acid removal by membrane electrodes 4. In this way, acid removal is suppressed as a whole. As seen, acid concentration in the aqueous solution W in ED tank 100 is effectively accomplished without adding acid from outside, and acid concentration is continuously kept within the set allowable range.

Now, without being bound by theory, an explanation will be provided as to the effect of ED coating on article 1 which is caused by suppressing the extraction of acid from ED tank 100 by adding D.I. water to electrolyte of membrane electrodes 3 or 4. Assume a case when article 1 comes to position (3) of high voltage zone $P_{H2}$ (both membrane electrodes 3 and 4 are close to each other). First we consider the electric resistance between membrane electrode 3 (high neutralizer removal type membrane electrodes) and article to be coated 1.

Total resistance $R_{00}$ for both membrane electrodes 3 and 4 are:

$$\begin{aligned} R_{00} = {} & R_1(\text{resistance of formed coating film; say 100K ohm}) + \\ & R_2(\text{resistance of paint path; say 50K ohm}) + \\ & R_3(\text{resistance of membrane; say 10 ohm}) + \\ & R_4(\text{resistance of electrolyte; say 10 ohm}) \\ = {} & 150020 \text{ ohm} \end{aligned}$$

Now, if D.I. water is added to the electrolyte of membrane electrode 3 and its resistance $R_4$ is doubled to 20 ohm, the total resistance $R_{01}$ becomes 150030 ohm. We will calculate the change of current (assuming the impressed voltage is 200 volts) between before and after the addition of D.I. water.

$$\begin{aligned} \text{Before addition of D.I. water } I_{00} &= E/E_{00} \\ &= 200/150020 \\ &= 0.0013331 \text{ A} \end{aligned}$$

$$\begin{aligned} \text{After addition of D.I. water } I_{01} &= E/E_{01} \\ &= 200/150030 \\ &= 0.0013330 \text{ A} \end{aligned}$$

and the rate of decrease is $$[(0.0013331 - 0.0012220)/0.0013331] \times 100\% = 0.0075\%$$

This is a negligible decrease.

On the other hand if we look at the resistance of membrane electrode 3 itself:

$$\begin{aligned} \text{Before addition of D.I. water} &= R_3(\text{membrane resistance}) + \\ & \quad R_4(\text{electrolyte resistance}) \\ &= 10 + 10 \text{ ohm} \\ &= 20 \text{ ohm} \end{aligned}$$

$$\begin{aligned} \text{After addition of D.I. water} &= R_3(\text{membrane resistance}) + \\ & \quad R_4(\text{electrolyte resistance}) \\ &= 10 + 20 \text{ ohm} \\ &= 30 \text{ ohm} \end{aligned}$$

As will be appreciated, the resistance of electrode 3 itself increases to 1.5 times the original value (resistance of membrane electrode 4 has not changed). The amount of acid extracted by membrane is proportional to the current. So, at the membrane electrode 3 (high neutralizer removal type membrane electrode), the current becomes 1/1.5(=2/3) and the amount removed reduces to 2/3. At the same time, the resistance of neighbor membrane electrode 4 (low neutralizer removal type membrane electrode) has not changed, and as seen the change of total current to article 1 is almost zero, the portion of current decreased with membrane electrode 3 is taken up by membrane electrode 4. For this reason, as discussed before, the change of resistance in membrane electrode 3 has little influence (and total current to article 1 remains unchanged).

When we consider the increase of neutralizer in ED tank 100 as coating film builds up on article 1, the removal of it can be controlled by the addition of D.I. water to membrane electrode 3. The same analysis may be applied to membrane electrodes 4. The argument used above with respect to currents that flow to membrane electrodes 3 and 4 in general is true only if the two types of electrodes are placed close to each other. If they are placed with a large distance from each other, the change of resistance within the cell itself is buried under the greater resistance of aqueous solution in the ED tank.

In this example, as the article proceeds to position (4), (high voltage zone $P_{H3}$) in $2^{nd}$ (high voltage zone) zone of FIGS. 1 and 8, there are only high neutralizer removal type membrane electrodes. In this case, as illustrated in FIG. 9, membrane electrodes 3 in zone marked as D ($2^{nd}$ and $3^{rd}$ from top of high voltage zone $P_{H3}$) will work and form an electric path with article 1. On the other hand, membrane electrodes 3 and 4 located upstream and downstream of zone marked D ($1^{st}$ and $4^{th}$ from top of high voltage zone $P_{H3}$) form only a weak path with article 1 as the distance is greater. The coating film formation is almost completed as article 1 comes to this point, and the film's resistance has increased to the order of 10 K ohm. For this reason, change of several 10 ohm resistance in electrodes 3 will not have much influence in the coating system as a whole. In other words, during the high voltage zone $P_{H3}$, also good control of acid concentration in aqueous solution W in ED tank 100 is continued while maintaining good quality of coating.

As explained above, according to this first example, it is possible to control the acid concentration in aqueous solution W in ED tank 100 to within a set range by controlling the acid concentration in the electrolyte of membrane electrode 3. Thus need of direct acid supply to ED tank 100 as in the prior art, is eliminated, and with it also other inconveniences of ED coating operation are eliminated or reduced. In the same manner, it is also possible to maintain the concentration of acid in aqueous solution in ED tank 100 within a set range by controlling acid concentration of electrolyte of membrane electrode 4.

Second Preferred Embodiment

Figure 10:
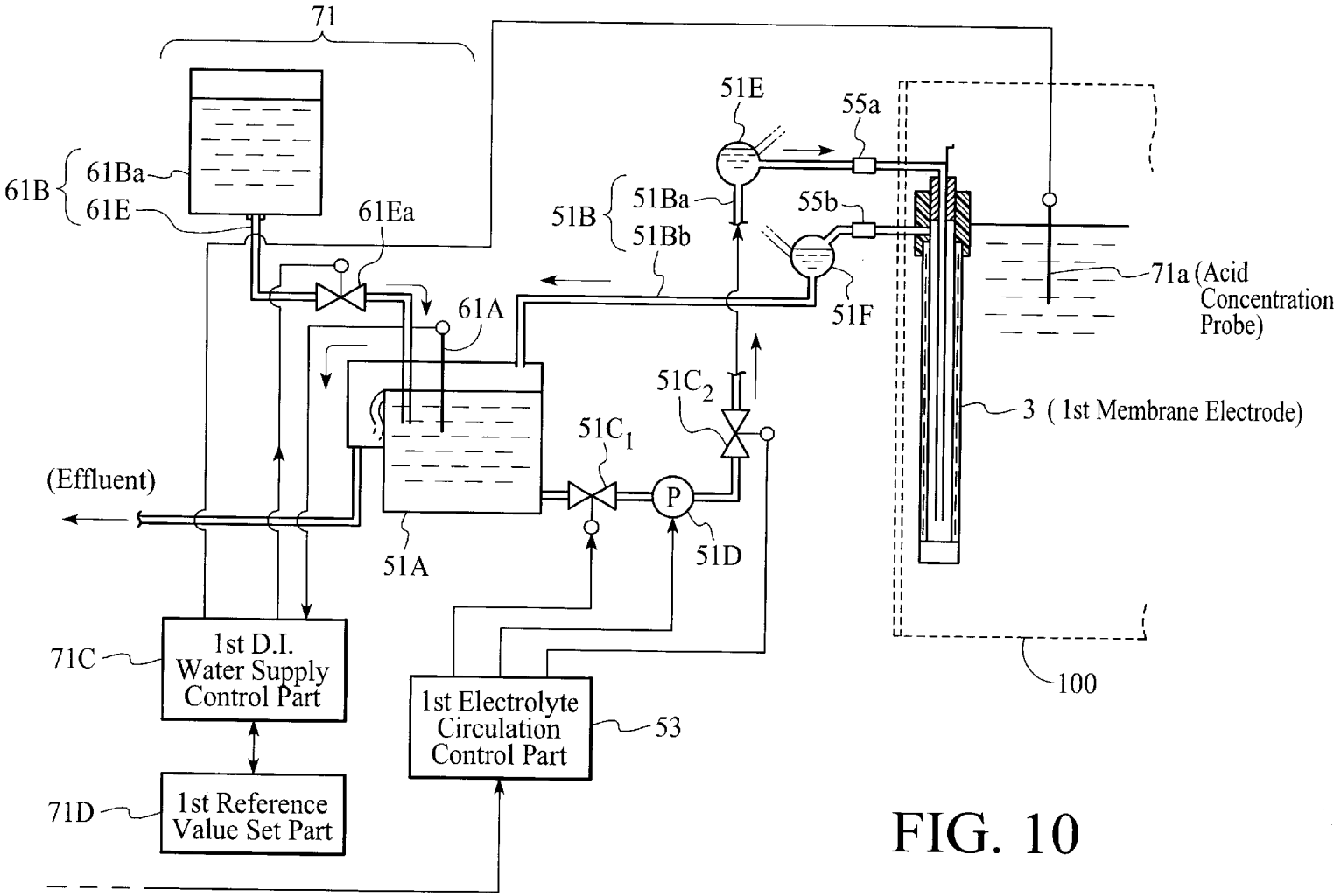
FIG. 10 illustrates a conceptual construction of the D.I. water supply control part used in a second preferred embodiment example.

Next explanation with respect to a second preferred embodiment will be provided with reference to FIG. 10. The same marks and numbers generally are used for second embodiment as first embodiment example.

The second embodiment of FIG. 10 has first and second acid control means of aqueous solution 71 which is made to directly measure acid concentration of aqueous solution in ED tank 100 by acid monitoring probe 71*a*, while the first embodiment was made to control acid concentration of electrolyte based on information of the conductivity of the electrolyte. First and second acid concentration control means 71 measure concentration of each electrolyte and, depending on this information, control acid concentration of electrolyte.

With this preferred embodiment, as with the case of the already discussed first embodiment, it is possible to indirectly control the acid concentration in aqueous solution W, and to keep it within a set allowable range, as well as it can eliminate the damage of tubular form electrode 30 in membrane electrode 3 that may be caused by excessive acid concentration. Now, a detailed explanation will be provided for the above-mentioned first (or second) acid concentration control means 71.

First acid concentration control means 71 for aqueous solution consists of first conductivity probe 61A, which measures the conductivity of the electrolyte of first electrolyte circulation system 51, first D.I. water supply device 61B which supplies a set amount of D.I. water, as dilution media, to the first electrolyte circulation system 51, first D.I. water supply control part 71C, which controls the operation of the D.I. water supply device 61B depending on the information from acid concentration probe 71*a* and first conductivity probe 61A, and first reference value setting part 71D, which has a built in association with first D.I. water supply control part 71C, and capable of setting reference conductivity values for electrolyte and reference concentration value of the aqueous solution in ED tank.

Also, second acid concentration control means of this second embodiment preferably is made in the same manner as the first acid concentration control mean 71, except with a second D.I. water supply device (not expressly shown). Here, in the second D.I. water supply control part (not expressly shown in drawing) in the second embodiment, a quite different reference value is set as compared with the reference value of first D.I. water supply control part 71C, just like in the case of the reference value of the electrolyte conductivity set in D.I. water supply control part 61C and 62C of the first embodiment. At the same time, a large reference value is set as the acid concentration reference value (conductivity value) of aqueous solution in the ED tank, as compared with the value of first D.I. water supply control part 71C. In general, the remaining portions may be constituted and operated in the same manner as with the first embodiment.

In this way, it not only may be implemented to provide the same function as in the first embodiment, but also it has an advantage to provide a faster and more direct response as it is made to avoid acid concentration from going down by directly measuring acid concentration in aqueous solution in ED tank 100.

Third Preferred Embodiment

Figure 11:
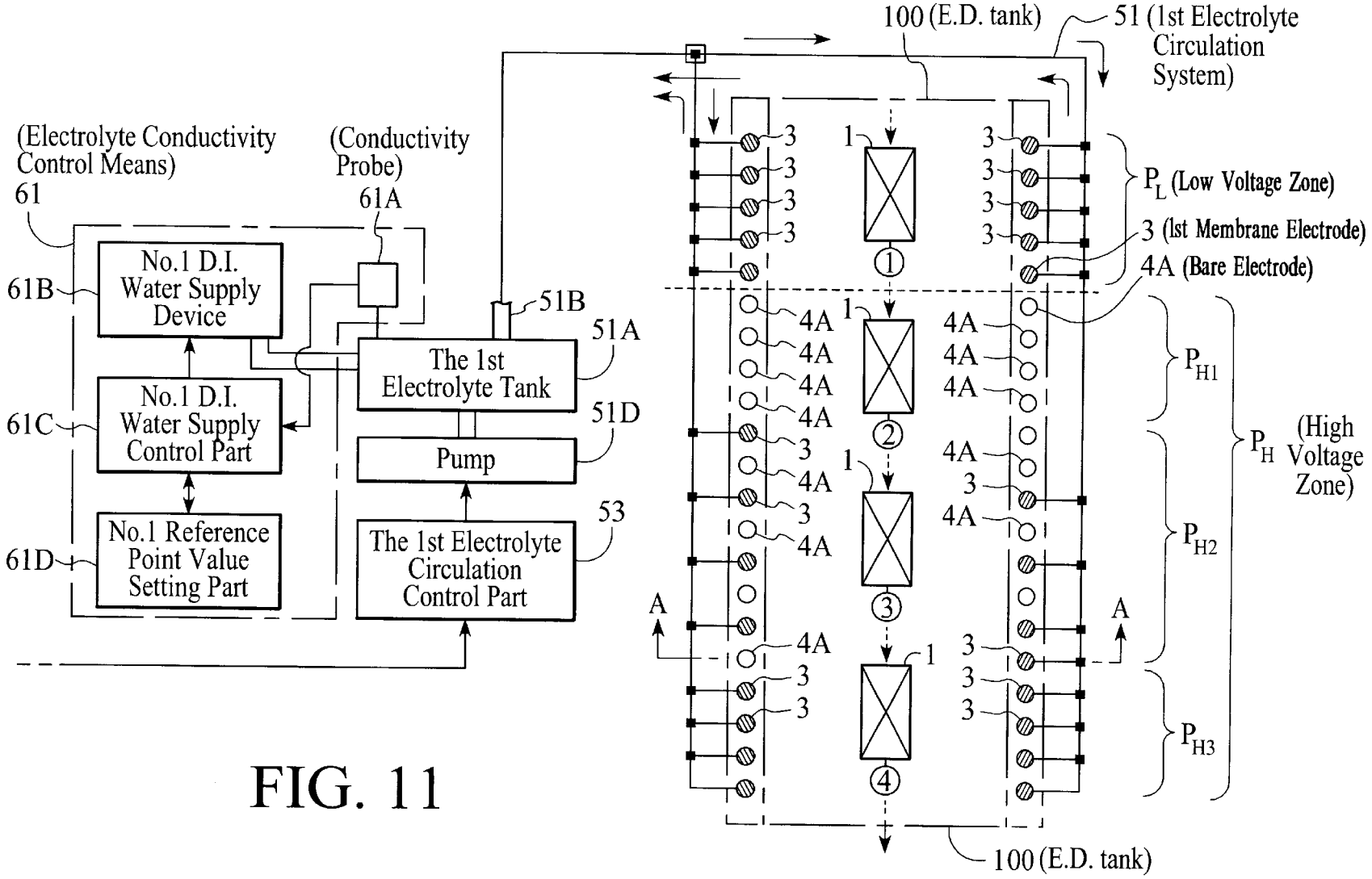
FIG. 11 is a drawing used to explain placement of membrane electrodes and bare electrodes in a third preferred embodiment.
Figure 12:
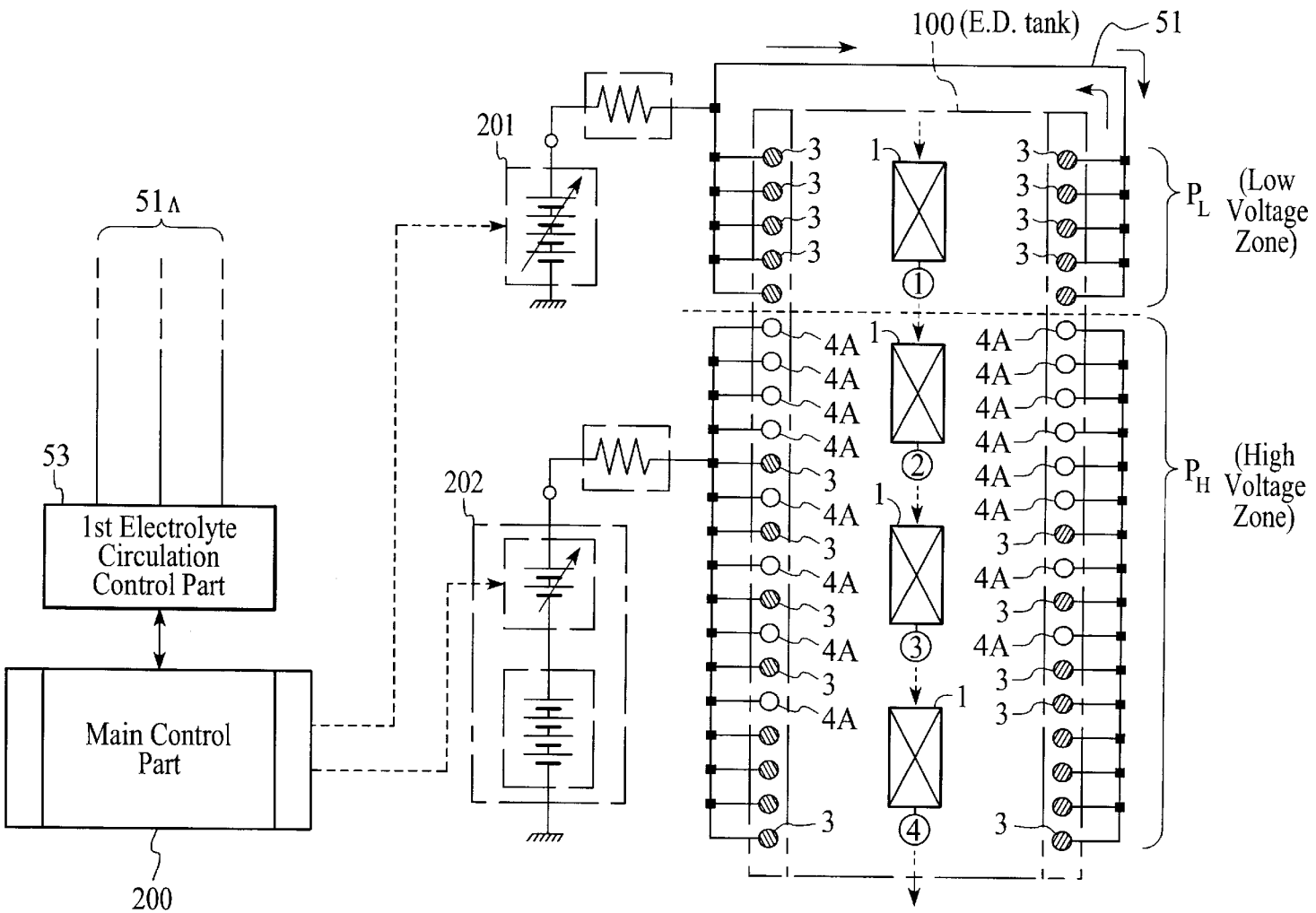
FIG. 12 is a drawing used to explain an arrangement of first type and second type membrane electrodes and the relationship between these electrodes and a power source.

Next an explanation will be provided for a third preferred embodiment with reference to FIGS. 11 and 12. In general, the same mark and numbers as used with reference to first embodiment are also used for the same parts in the third embodiment for the parts that are equivalent in both embodiments.

The third embodiment, as illustrated in FIGS. 11 and 12, it is characterized in that second membrane electrode 4 is replaced with bare electrode 4A, while the first embodiment preferably uses both first membrane electrodes 3 as high neutralizer removal type and second membrane electrodes 4 as low neutralizer removal type. When bare electrodes 4A are used, second electrolyte circulation system 52 and second acid control means for aqueous solution 62, which are required in both first and second embodiments, are not necessary. Electric circuitry required in this embodiment preferably are implemented in a manner the same as or analogous to those used in the first and second embodiments, as illustrated generally in FIGS. 11 and 12. In general, the remaining portions may be constituted and operated in the same manner as with the first and second embodiments.

The manner in which this third embodiment functions is generally the same as in the first and second embodiments and it has an added potential advantage in reduced cost as the number of second type membrane electrodes 4 of second electrodes as opposed to first electrode can be replaced with bare electrodes made of corrosion resistant material. Further, as it is made to control acid concentration in aqueous solution in the ED tank using only first electrolyte circulation system 51 and first electrolyte conductivity control means 61, overall operation and maintenance may become simpler.

In accordance with such embodiments, it is preferred to place membrane electrodes 3 and bare electrodes 4A along both side walls of ED tank 100 in such a way that high neutralizer removal type membrane electrodes 3 are placed in the low voltage zone $P_L$, where the article 1 enters, and membrane electrodes 3 and bare electrodes 4A are placed mixed in the high voltage zone $P_H$. Further it is preferred to have a sub-zone in the high voltage zone $P_H$ where high neutralizer removal type membrane electrodes 3 and bare electrodes are placed alternately one by one, or likewise two by two (or n by n, etc.).

(Effects of the Present Invention)

Certain of the effects, advantages and benefits in accordance with the present invention will now be described. The present invention in accordance with preferred and alternative embodiments, if applied to, for example, cation ED coating, it is possible to control the acid concentration in the ED paint to within a set range. As a result, the addition of acid to the ED paint from outside which was required in the prior art is eliminated, and at the same time the undesirable fluctuation of paint characteristics caused by intermittent addition of acid can be eliminated or substantially reduced.

As will be appreciated, in accordance with the present invention a mixture of two types of membrane electrodes, one high neutralizer removal type membrane electrodes 3 and the other low neutralizer removal type membrane electrodes 4 (or 4A), are placed in the ED tank. To each group of these two types of electrodes separate and independent electrolyte circulation systems 51 and 52 are connected. To each of these circulation systems are connected correspondingly first and second electrolyte conductivity control means 61 and 62, each of which works to add D.I. water, as a dilution media, to the corresponding electrolyte circulation system, when the conductivity exceeds pre-set reference conductivity value. By manipulating one or both of the pre-set reference conductivity values mentioned above, change of the removal of neutralizer from ED paint in different rates per unit electric current that flows for ED coating may be achieved, and more desirable and advantageous ED coating operations may be performed, such as on objects such as car bodies, appliance bodies, and other metallic housing, structures and other implements.

(Additional Explanation of Marks and Numbers)

$1^{st}$ electrode as article to be coated
$2^{nd}$ electrode as opposed to 1 electrode
$1^{st}$ type membrane electrodes
$2^{nd}$ type membrane electrodes
cation exchange membrane of second type membrane electrode
Space electrolyte to flow through
Tubular electrode made of corrosion resistant material
$1^{st}$ electrolyte circulation system
51A $1^{st}$ electrolyte tank
51B, 52B Piping
51C1, 51C2 valves
51D, 52D pumps
$2^{nd}$ electrolyte circulation system
52A $2^{nd}$ electrolyte tank
$1^{st}$ electrolyte circulation control part
$2^{nd}$ electrolyte circulation control part
$1^{st}$ electrolyte conductivity control means
61A, 62A conductivity probe
61B $1^{st}$ D.I. water supply device
61C $1^{st}$ D.I. water supply control part
$2^{nd}$ electrolyte conductivity control means
62B $2^{nd}$ D.I. water supply device
62C $2^{nd}$ D.I. water supply control part
electrolyte conductivity control means
71*a* acid concentration probe
100 ED tank (ED coating tank)
$E_L$ Lower reference conductivity set point
Es conductivity of electrolyte
$P_H$ High voltage zone
$P_L$ Low voltage zone
W aqueous solution for ED coating (ED paint)

Although the invention has been described in conjunction with specific preferred and other embodiments, it is evident that many substitutions, alternatives and variations will be apparent to those skilled in the art in light of the foregoing description. Accordingly, the invention is intended to embrace all of the alternatives and variations that fall within the spirit and scope of the appended claims. For example, it should be understood that, in accordance with the various alternative embodiments described herein, various systems, and uses and methods based on such systems, may be obtained. The various refinements and alternative and additional features also described may be combined to provide additional advantageous combinations and the like in accordance with the present invention. Also as will be understood by those skilled in the art based on the foregoing description, various aspects of the preferred embodiments may be used in various subcombinations to achieve at least certain of the benefits and attributes described herein, and such subcombinations also are within the scope of the present invention. All such refinements, enhancements and further uses of the present invention are within the scope of the present invention.

What is claimed is:

1. An electrodeposition coating system comprising:

a first electrode as an article to be coated provided in an electrodeposition bath and a plurality of second electrodes provided in association with the first electrode, wherein current is passed between the first electrode and the second electrodes through an aqueous solution of a substance contained in the electrodeposition bath, to electrodeposit the substance for forming a coating film onto the article to be coated, wherein each of the second electrodes comprises an electrode and a membrane which separates the electrode from the aqueous solution, wherein a second set of the second electrodes each comprise a low acid removal membrane electrode, wherein each of the second electrodes in the second set is provided with a corrosion resistant electrode material and a second membrane having a function of precluding most of a flow of an ionized neutralizing agent in the aqueous solution from being extracted, and wherein a first set of the second electrodes each comprise a high acid removal membrane electrode, wherein each of the second electrodes in the first set is provided with an electrode material and a membrane having a function of osmotically extracting the neutralizing agent from the aqueous solution, wherein a number of the low acid removal membrane electrodes and the high acid removal membrane electrodes are placed along a bath paint tank wall, wherein each of the high acid removal membrane electrodes is coupled to a first electrolyte circulation system to flow electrolyte from a first end of the high acid removal membrane electrode to a second end of the high acid removal membrane electrode between its first membrane and its electrode material, wherein each of the low acid removal membrane electrodes is coupled to a second electrolyte circulation system to flow electrolyte from a first end of the low acid removal membrane electrode to a second end of the low acid removal membrane electrode between its second membrane and its corrosion resistant electrode material, wherein the second electrolyte circulation system operates independently from the first electrolyte circulation system, wherein each of the first and second electrolyte circulation systems are provided with a corresponding first or second conductivity control system, wherein each of the first and second electrolyte conductivity control system is selectively activated if conductivity of the electrolyte in the corresponding first or second electrolyte circulation system exceeds a pre-set reference conductivity value and operates to introduce D.I. water to the electrolyte of the corresponding first or second electrolyte circulation system as a dilution media, wherein the second conductivity control system has a higher pre-set reference conductivity value than that of the first conductivity control system.

2. The electrodeposition coating system of claim 1, wherein the first and second electrolyte control systems each has a corresponding first or second conductivity probe which monitors conductivity of the electrolyte of the corresponding first or second electrolyte circulation system, wherein the first and second electrolyte control systems each has a corresponding first or second DI water supply device to add DI water to the corresponding first or second electrolyte circulation system, wherein the first and second electrolyte control systems each has a corresponding first or second D.I. water supply control part to selectively send a signal to the corresponding first or second water supply device to selectively activate and inactivate the corresponding first or second water supply device based on the relationship between the corresponding conductivity and the corresponding pre-set reference conductivity value, wherein the first and second D.I. water supply control parts each has a corresponding first or second part by which to set or change the corresponding reference conductivity value, and characterized in that the reference conductivity values can be set for the first and second electrolyte supply control parts independently of each other.

3. The electrodeposition coating system of claim 2, wherein the first and second electrolyte circulation systems each correspondingly has a first or second electrolyte tank to hold a set amount of electrolyte, piping between the first or second electrolyte tanks and the corresponding high acid removal membrane electrodes or the low acid removal membrane electrodes, and a corresponding first or second pump and a corresponding first or second valve built into the corresponding piping, wherein the first and second electrolyte circulation systems each are provided with a corresponding first or second electrolyte circulation control part to control correspondingly the first and second pumps and valves, while each of the low acid removal membrane electrodes and high acid removal membrane electrodes are correspondingly grouped together through corresponding headers for electrolyte supply and return.

4. An electrodeposition coating system comprising:

a first electrode as an article to be coated provided in an electrodeposition bath; and a plurality of second electrodes provided in association with the first electrode, wherein current is passed between the article to be coated and the second electrodes through an aqueous solution of a substance contained in the electrodeposition bath to electrodeposit the substance for forming a coating film onto the article to be coated, wherein the second electrodes each comprise an electrode and a membrane which separates the electrode from the aqueous solution, wherein a second set of the second electrodes are low acid removal electrodes each having a corrosion resistant electrode material and a second membrane having a function of precluding most of a flow of ionized neutralizing agent in the aqueous solution from being extracted, and wherein a first set of the second electrodes are high acid removal electrodes each having an electrode material and a first membrane having a function of osmotically extracting the neutralizing agent from the aqueous solution, wherein a number of the low acid removal membrane electrodes and the high acid removal of membrane electrodes are placed along a bath paint tank wall, and each of the high acid removal membrane electrodes is provided with a first electrolyte circulation system to flow electrolyte from a first end of the high acid removal membrane electrode to a second end of the high acid removal membrane electrode between its first membrane and its electrode material, wherein each of the low acid removal membrane electrodes is provided with a second electrolyte circulation system to flow electrolyte from a first end of the low acid removal membrane electrode to a second end of the low acid removal membrane electrode between its second membrane and its corrosion resistant electrode material and operating independently from the first electrolyte circulation system, wherein the first electrolyte circulation system is provided with a first electrolyte conductivity control system operating to control conductivity of electrolyte of first electrolyte circulation system by adding D.I. water for dilution so to keep its electrolyte conductivity within a predetermined conductivity range, and the second electrolyte circulation system is provided with a second electrolyte conductivity control system operating to control conductivity of electrolyte of the second electrolyte circulation system below a set value by adding D.I. water when the conductivity of the electrolyte of the second electrolyte circulation system exceeds a pre-set reference conductivity value until the conductivity is controlled below the pre-set reference conductivity value, wherein the preset reference conductivity value according to which second electrolyte conductivity control operates is set greater than a maximum value of the predetermined conductivity range according to which the first electrolyte conductivity control operates.

5. An electrodeposition coating system comprising:

a first electrode as an article to be coated provided in an electrodeposition bath and a plurality of second electrodes provided in association with the first electrode, wherein current is passed between the article to be coated and the second electrodes through an aqueous solution of a substance contained in the electrodeposition bath to electrodeposit the substance for forming a coating film onto the article to be coated, wherein each of the second electrodes comprises an electrode and a membrane which separates the electrode from the aqueous solution, wherein a second set of the second electrodes each comprise a low acid removal electrode of a corrosion resistant electrode material and a second membrane having a function of precluding most of the flow of an ionized neutralizing agent in the aqueous solution from being extracted, and wherein a first set of the second electrodes each comprise a high acid removal electrode of an electrode material and a first membrane having a function of osmotically extracting the neutralizing agent, wherein a number of low acid removal membrane electrodes and high acid removal membrane electrodes are placed along a bath paint tank wall, wherein each of the high acid removal membrane electrodes is provided with a first electrolyte circulation system to run electrolyte from a first end of the high acid removal membrane electrode to a second end of the high acid removal membrane electrode between its first membrane and electrode material, wherein each of the low acid removal membrane electrodes is provided with a second electrolyte circulation system to run electrolyte from a first end of the low acid removal membrane electrode to a second end of the low acid removal membrane electrode between its second membrane and corrosion resistant electrode material, wherein the second electrolyte circulation system is operable independently from the first electrolyte circulation system, wherein each of the first and second electrolyte circulation systems is provided with a corresponding first or second conductivity control system which controls the conductivity of electrolyte of the corresponding first and second electrolyte circulation system in pre-set conductivity ranges, wherein maximum and minimum reference values of the conductivity range controlled by the second conductivity control system are set higher than maximum and minimum reference values of the conductivity range controlled by the first conductivity control system.

6. The electrodeposition coating system of claim 5, where the first and second electrolyte control system each has a corresponding first or second conductivity probe which monitors conductivity of electrolyte of the corresponding first or second electrolyte circulation system and a corresponding first or second DI water supply device to add DI water as dilution media to the corresponding first or second electrolyte circulation system and a corresponding first or second D.I. water supply control part operating responsive to a signal from the corresponding first or second conductivity probe and controlling the corresponding first or second water supply device, wherein the first and second D.I. control parts each has a capability to adjust the maximum or minimum reference values of the corresponding conductivity range.

7. An electrodeposition coating system comprising a first electrode as an article to be coated provided in an electrodeposition bath and a plurality of second electrodes provided in association with the first electrode, wherein current is passed between the article to be coated and the second electrodes through an aqueous solution of a substance contained in the electrodeposition bath to electrodeposit the substance for forming a coating film onto the article to be coated, wherein the second electrodes each comprise an electrode and a membrane which separates the second electrode from the aqueous solution, wherein a second set of the second electrodes each comprise a low acid removal electrode provided with a corrosion resistant electrode material and a second membrane having a function of precluding most of the flow of an ionized neutralizing agent in the aqueous solution from being extracted, and a first set of the second electrodes each comprise a high acid removal electrode provided with an electrode material and a first membrane having a function of osmotically extracting the neutralizing agent, wherein a number of the low acid removal membrane electrodes and high acid removal membrane electrodes are placed along a bath paint tank wall, wherein each of the high acid removal membrane electrodes is provided with a first electrolyte circulation system to run electrolyte from a first end of the high acid removal membrane electrode to a second end of the high acid removal membrane electrode between its first membrane and electrode material, wherein each of the low acid removal membrane electrodes is provided with a second electrolyte circulation system to run electrolyte from a first end of the low acid removal membrane electrode to a second end of the low acid removal membrane electrode between its second membrane and corrosion resistant electrode material, wherein the second electrolyte circulation system is operable independently from the first electrolyte circulation system, wherein an acid concentration probe is provided in the aqueous solution to measure acid concentration in the aqueous solution, wherein each of the first and second electrolyte circulation systems are provided with a corresponding and independent first or second conductivity control element which is selectively activated if conductivity in the bath paint becomes lower than a set point to introduce D.I. water to either the first or second electrolyte circulation system as dilution media.

8. The electrodeposition coating system of claim 7, wherein the first and second electrolyte control element each has a corresponding first or second conductivity probe which measures conductivity of the electrolyte of the corresponding first or second electrolyte circulation system, a corresponding first or second D.I. water supply device supplying D.I. water as dilution media to the electrolyte of the corresponding first or second electrolyte circulation system and a corresponding first or second D.I. water supply control part which controls the corresponding first or second D.I. water supply device depending on information from the acid concentration probe and/or from the first or second conductivity probes, wherein each of the first or second D.I. water supply control part is provided with a corresponding first or second part to set a reference conductivity of the aqueous solution or a corresponding reference conductivity of the electrolyte.

9. The electrodeposition coating system of claim 1, 2, 3, 4, 5, 6, 7 or 8, wherein a plurality of the membrane electrodes are installed along an electrodeposition coating tank wall in such a way that the high acid removal membrane electrodes are placed in an upstream (first) zone where the article to be coated is brought into the aqueous solution and a first voltage level is impressed between the membrane electrodes and the article to be coated, wherein a plurality of each of the high acid removal membrane electrodes and low acid removal membrane electrodes are placed in a downstream (second) zone where a second voltage level is impressed between the high acid removal membrane electrodes and the low acid removal membrane electrodes and the article to be coated, wherein the second voltage level is higher than the first voltage level.

10. The electrodeposition coating system of claim 9 wherein, in the downstream (second) zone, the low acid removal and high acid removal membrane electrodes are positioned, from an upstream to downstream direction, to provide a zone of only low acid removal membrane electrodes, a zone of both low and high acid removal membrane electrodes, and a zone of only high acid removal membrane electrodes.

11. The electrodeposition coating system of claim 9 wherein, in the downstream (second) zone, there is a zone in which the low acid removal and high acid removal membrane electrodes are positioned in an alternating manner.

12. The electrodeposition coating system of claim 9 wherein, in the downstream (second) zone, the low acid removal and high acid removal membrane electrodes are positioned alternately two by two.

13. An electrodeposition coating system comprising a first electrode as an article to be coated provided in an electrodeposition bath and a plurality of second electrodes provided in association with the first electrode, wherein current is passed between the article to be coated and the second electrodes through an aqueous solution of a substance contained in the electrodeposition bath to electrodeposit die substance for forming a coating film onto the article to be coated, wherein the second electrodes comprise at least first and second electrodes, a second electrode each comprising a bare electrode of a corrosion resistant material, and a first electrode each comprising a membrane electrode having an electrode material and membrane which separates the electrode material from the aqueous solution, wherein the fast electrodes comprise high acid removal membrane electrodes having a membrane that osmotically extracts neutralizer ion in the electrodeposition bath, wherein a number of bare electrodes and high acid removal of membrane electrodes are placed along an electrodeposition coating tank wall, wherein each of the high acid removal membrane electrodes is provided with a first electrolyte circulation system to run electrolyte from a first end of the high acid removal membrane electrode to a second end of the high acid removal membrane electrode between its membrane and electrode material, wherein the first electrolyte circulation system is provided with a conductivity control system which operates to control conductivity of electrolyte within a set range by adding D.I. water to the electrolyte.

14. The electrodeposition coating system of claim 13, wherein the bare electrodes and high acid removal membrane electrodes are positioned along an electrodeposition coating tank wall in such a way that high acid removal membrane electrodes are placed in an upstream (first) zone where the article to be coated is brought into the aqueous solution and a first voltage level is impressed between the electrodes and the article to be coated, wherein in a downstream (second) zone where a second voltage level is impressed between the electrodes and the article to be coated and high acid removal membrane electrodes and bare electrodes are placed in a mixed manner.

15. The electrodeposition coating system of claim 14, wherein, in the downstream (second) zone, from an upstream to downstream direction, there are sub-zones consisting of a zone in which only bare electrodes are placed, a zone in which bare electrodes and high acid removal membrane electrodes are placed in a mixed manner, and a zone in which only high acid removal membrane electrodes are placed.

16. The electrodeposition coating system of claim 14, wherein, in the downstream (second) zone where the second voltage level is impressed, there is a zone in which the bare electrodes and high acid removal membrane electrodes are positioned alternately.

17. The electrodeposition coating system of claim 14, wherein, in the downstream (second) zone where the second voltage level is impressed, there is a zone in which the bare electrodes and high acid removal membrane electrodes are positioned alternately two by two.

18. An electrodeposition coating system comprising:

a first electrode as an article to be coated provided in an electrodeposition bath and a plurality of second electrodes provided in association with the first electrode, wherein current is passed between the first electrode and the second electrodes through an solution of a substance contained in the electrodeposition bath, to electrodeposit the substance for forming a coating film onto the article to be coated, wherein a second set of the second electrodes each comprise a low neutralizer removal electrode, wherein each of the second electrodes in the second set is provided with a corrosion resistant electrode material and has a function of precluding at least most of a flow of an ionized neutralizing agent in the solution from being extracted, and wherein a first set of the second electrodes each comprise a high neutralizer removal membrane electrode, wherein each of the second electrodes in the first set is provided with an electrode material and a membrane having a function of osmotically extracting the neutralizing agent from the aqueous solution, wherein a number of the low neutralizer removal electrodes and the high neutralizer removal membrane electrodes are placed along a bath paint tank wall, wherein each of the high neutralizer removal membrane electrodes is coupled to a first electrolyte circulation system to flow electrolyte from a first end of the high neutralizer removal membrane electrode to a second end of the high neutralizer removal membrane electrode between its membrane and its electrode material, wherein the first electrolyte circulation systems is provided with a corresponding first conductivity control system, wherein the first electrolyte conductivity control system is selectively activated if conductivity of the electrolyte in the corresponding first electrolyte circulation system exceeds a pre-set reference conductivity value and/or if the neutralizer concentration in the solution exceeds a pre-set reference concentration value, and wherein the first electrolyte conductivity control system operates to control the introduction of a dilution media to the electrolyte of the corresponding first electrolyte circulation system.

19. The system of claim 18, further comprising a first conductivity probe which measures conductivity of the electrolyte of the first electrolyte circulation system, wherein a dilution media supply device provides the dilution media to the electrolyte of the corresponding first electrolyte circulation system responsive to a signal from the first conductivity probe.

20. The system of claim 18, further comprising a neutralizer concentration probe which measures the concentration of neutralizer in the solution, wherein a dilution media supply device provides the dilution media to the electrolyte of the corresponding first electrolyte circulation system responsive to a signal from the neutralizer concentration probe.

21. The system of claim 18, wherein the corrosion resistant electrode material comprises titanium, titanium on which iridium oxide is coated, or conductive ferrite.

22. The system of claim 18, wherein the low neutralizer removal electrodes comprise bare electrodes or low neutralizer removal membrane electrodes.

23. The system of claim 18, wherein the low neutralizer removal electrodes comprise low neutralizer removal membrane electrodes, wherein each of the low neutralizer removal membrane electrodes is coupled to a second electrolyte circulation system to flow electrolyte from a first end of the low neutralizer removal membrane electrode to a second end of the low neutralizer removal membrane electrode between a second membrane and its corrosion resistant electrode material, wherein the second membrane provides a lower rate of removal of neutralizer from the solution as compared to the membrane of the high neutralizer removal membrane electrodes.

24. The system of claim 23, wherein the second electrolyte circulation system operates independently from the first electrolyte circulation system.

25. The system of claim 23, wherein the second electrolyte circulation systems is provided with a corresponding second conductivity control system, wherein the second electrolyte conductivity control system is selectively activated if conductivity of the electrolyte in the corresponding second electrolyte circulation system exceeds a pre-set reference conductivity value and/or if the neutralizer concentration in the solution exceeds a pre-set reference concentration value, and wherein the second electrolyte conductivity control system operates to control the introduction of a dilution media to the electrolyte of the corresponding second electrolyte circulation system.

26. The system of claim 25, wherein each of the first and second conductivity control systems operates responsive to one or more pre-set reference conductivity values, wherein the one or more pre-set reference conductivity values of the second conductivity control system have a higher conductivity value than the one or more pre-set reference conductivity values of the first conductivity control system.

27. The system of claim 26, wherein system operates to maintain neutralizer balance in the solution.

28. The system of claim 18, wherein a plurality of the membrane electrodes are installed along an electrodeposition coating tank wall in such a way that at least an upstream (first) zone is created and a downstream (second) zone is created, wherein the high neutralizer removal membrane electrodes and the low neutralizer removal electrodes are positioned in the first and second zones so tat the effect of the high neutralizer removal membrane electrodes predominate the first zone and that the high neutralizer removal membrane electrodes and the low acid removal electrodes provide a mixed effect in the second zone.

29. The system of claim 28, wherein a first voltage level is impressed between the second electrodes and the article to be coated in the first zone, wherein a second voltage level is impressed between the second electrodes in the second zone.

30. The system of claim 29, wherein the second voltage level is higher than the first voltage level.

31. The system of claim 29, wherein a first power source providing the first voltage level comprises a soft starting power supply.

32. The system of claim 31, wherein a second power source providing the second voltage level comprises a non-soft starting power supply.

33. The system of claim 28, wherein the first zone contains only high neutralizer removal membrane electrodes.

34. The system of claim 28, wherein the second zone contains a mixed arrangement of high neutralizer removal membrane electrodes and low neutralizer removal electrodes.

35. The system of claim 34, wherein, in the second zone, the high neutralizer removal membrane electrodes and the low neutralizer removal electrodes are provided in an alternating manner.

36. The system of claim 35, wherein the high neutralizer removal membrane electrodes and the low neutralizer removal electrodes are provided in an N by N arrangement, with N high neutralizer removal membrane electrodes followed by N low neutralizer removal electrodes, where N is one or more than one.

37. The system of claim 18, wherein the low neutralizer removal electrodes have a removal efficiency of less than about $1\times10^{-6}$ mole/Coulomb.

* * * * *